US006937979B2

(12) United States Patent
Gao et al.

(10) Patent No.: US 6,937,979 B2
(45) Date of Patent: Aug. 30, 2005

(54) CODING BASED ON SPECTRAL CONTENT OF A SPEECH SIGNAL

(75) Inventors: Yang Gao, Mission Viejo, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 742 days.

(21) Appl. No.: 09/896,682

(22) Filed: Jun. 29, 2001

(65) Prior Publication Data

US 2002/0049585 A1 Apr. 25, 2002

Related U.S. Application Data

(63) Continuation-in-part of application No. 09/783,822, filed on Feb. 14, 2001.

(60) Provisional application No. 60/233,044, filed on Sep. 15, 2000.

(51) Int. Cl.[7] ..... G10L 19/00

(52) U.S. Cl. ..... 704/230; 704/219; 704/222

(58) Field of Search ..... 704/219–223, 704/230, 201

(56) References Cited

U.S. PATENT DOCUMENTS

| | | | | |
|---|---|---|---|---|
| 5,341,456 A | | 8/1994 | Dejaco | |
| 5,414,796 A | * | 5/1995 | Jacobs et al. | 704/221 |
| 5,651,091 A | * | 7/1997 | Chen | 704/223 |
| 5,657,420 A | * | 8/1997 | Jacobs et al. | 704/223 |
| 5,664,055 A | * | 9/1997 | Kroon | 704/223 |
| 5,692,098 A | * | 11/1997 | Kurdziel | 704/202 |
| 5,778,338 A | * | 7/1998 | Jacobs et al. | 704/223 |
| 5,915,235 A | | 6/1999 | Miller et al. | |
| 6,324,505 B1 | * | 11/2001 | Choy et al. | 704/230 |
| 6,393,394 B1 | * | 5/2002 | Ananthapadmanabhan et al. | 704/230 |
| 6,456,964 B2 | * | 9/2002 | Manjunath et al. | 704/205 |
| 6,463,407 B2 | * | 10/2002 | Das et al. | 704/208 |
| 6,584,438 B1 | * | 6/2003 | Manjunath et al. | 704/228 |
| 6,691,084 B2 | * | 2/2004 | Manjunath et al. | 704/221 |

OTHER PUBLICATIONS

Massaloux D et al: "Spectral Shaping in the Proposed ITU–T 8 kb/s Speech Coding Standard" Proceedings of the IEEE Workshop on Speech Coding for Telecommunications, XX, XX, 1995, pp. 9–10, XP002192645 paragraph '0002!.

* cited by examiner

*Primary Examiner*—David L. Ometz
*Assistant Examiner*—Michael N. Opsasnick
(74) *Attorney, Agent, or Firm*—Farjami & Farjami LLP

(57) ABSTRACT

In a coding procedure, a spectral content of a speech signal is estimated. A preferential coding algorithm or preferential value of at least one coding parameter is selected based on the estimated spectral content of the speech signal. The speech signal is coded in accordance with the selected coding algorithm or the selected coding parameter to control the operation of one or more of the following: a pre-processing filter, a post-processing filter, a coding control coefficient, a weighting filter, a synthesis filter, and a quantization table.

18 Claims, 10 Drawing Sheets

CODING BASED ON SPECTRAL CONTENT OF A SPEECH SIGNAL

CROSS REFERENCE TO RELATED APPLICATIONS

This is a continuation-in-part of U.S. patent application Ser. No. 09/783,822, which was filed on Feb. 14, 2001 and which claims the benefit of provisional application Ser. No. 60/233,044, filed on Sep. 15, 2000 under 35 U.S.C. 119(e).

BACKGROUND OF THE INVENTION

1. Technical Field

This invention relates to selection of coding parameters based on spectral content or tilt of a speech signal.

2. Related Art

An analog portion of a communications network may detract from the desired audio characteristics of vocoded speech. In a public switched telephone network, a trunk between exchanges or a local loop from a local office to a fixed subscriber station may use analog representations of the speech signal. For example, a telephone station typically transmits an analog modulated signal with an approximately 3.4 KHz bandwidth to the local office over the local loop. The local office may include a channel bank that converts the analog signal to a digital pulse-code-modulated signal (e.g., DS0). An encoder in a base station may subsequently encode the digital signal, which remains subject to the frequency response originally imparted by the analog local loop and the telephone.

The analog portion of the communications network may skew the frequency response of a voice message transmitted through the network. A skewed frequency response may negatively impact the digital speech coding process because the digital speech coding process may be optimized for a different frequency response than the skewed frequency response. As a result, analog portion may degrade the intelligibility, consistency, realism, clarity or another performance aspect of the digital speech coding.

The change in the frequency response may be modeled as one or more modeling filters interposed in a path of the voice signal traversing an ideal analog communications network with an otherwise flat spectral response. A Modified Intermediate Reference System (MIRS) refers to a modeling filter or another model of the spectral response of a voice signal path in a communications network. If a voice signal that has a flat spectral response is inputted into an MIRS filter, the output signal has a sloped spectral response with amplitude that generally increases with a corresponding increase in frequency.

An encoder or a decoder may perform inconsistently upon exposure to different spectral characteristics of analog portions of various communications networks. The inconsistency may translate to an inadequate level of perceptual quality at times. Thus, a need exists for selecting preferential values of coding parameters based on the spectral characteristics of the input voice signal to be coded.

SUMMARY

A coding system determines or selects a preferential value of a coding parameter or a preferential coding algorithm based on a spectral response of the speech signal to enhance the perceptual quality of reproduced speech. In accordance with one aspect of the invention, a method for coding a speech signal comprises estimating a spectral content of a speech signal. A preferential coding algorithm is selected from an assortment of coding algorithms based on the estimated spectral content of the speech signal. The speech signal is coded in accordance with the selected coding algorithm, where the selected algorithm may control the operation of one or more of the following: a pre-processing filter, a post-processing filter, a coding control coefficient, a weighting filter, a synthesis filter, and a quantization table.

In accordance with another aspect of the invention, at least one coding parameter value is varied or selected based on the estimated spectral content of the speech signal. Further, the speech signal is coded in accordance with the varied or selected coding parameter; the varied coding parameter is associated with one or more of the following: a preprocessing filter, a post-processing filter, a coding control coefficient, a weighting filter, a synthesis filter, and a quantization table.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

Like reference numerals designate corresponding parts throughout the different figures.

DETAILED DESCRIPTION OF THE PREFERRED EMBODIMENT

The term coding refers to encoding of a speech signal, decoding of a speech signal or both. An encoder codes or encodes a speech signal, whereas a decoder codes or decodes a speech signal. The term coder refers to an encoder or a decoder. The encoder may determine coding parameters that may be used in an encoder to encode a speech signal, in a decoder to decode the encoded speech signal, or in both the encoder and the decoder. Encoding parameters and encoding parameter values apply to an encoder. Decoding parameters and decoding parameter values apply to a decoder.

Figure 1:
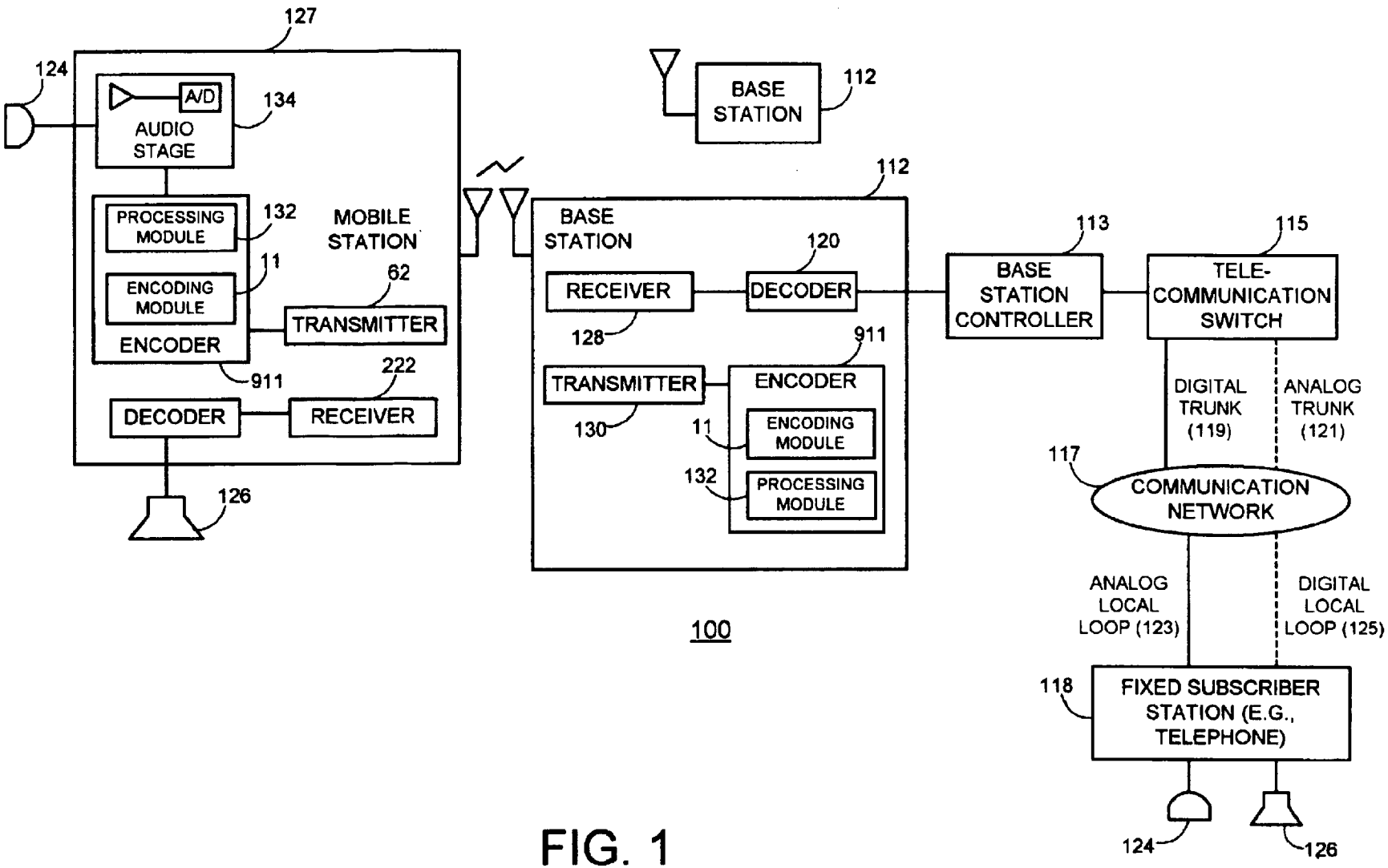
FIG. 1 is a block diagram of a communications system incorporating a processing module for selection of at least one appropriate value of a coding parameter for a respective coder.

FIG. 1 shows a block diagram of a communications system 100 that incorporates a processing module 132 for selection of a preferential value of one or more coding parameters based on the spectral content of a speech signal. The communications system 100 includes a mobile station 127 that communicates to a base station 112 via electromagnetic energy (e.g., radio frequency signal) consistent with an air interface. In turn, the base station 112 may communicate with a fixed subscriber station 118 via a base station controller 113, a telecommunications switch 115, and a communications network 117. The base station controller 113 may control access of the mobile station 127 to the base station 112 and allocate a channel of the air interface to the mobile station 127. The telecommunications switch 115 may provide an interface for a wireless portion of the communications system 100 to the communications network 117.

For an uplink transmission from the mobile station 127 to the base station 112, the mobile station 127 has a microphone 124 that receives an audible speech message of acoustic vibrations from a speaker or source. The microphone 124 transduces the audible speech message into a speech signal. In one embodiment, the microphone 124 has a generally flat spectral response across a bandwidth of the audible speech message so long as the speaker has a proper distance and position with respect to the microphone 124. An audio stage 134 preferably amplifies and digitizes the speech signal. For example, the audio stage 134 may include an amplifier with its output coupled to an input of an analog-to-digital converter. The audio stage 134 inputs the speech signal into the encoder 911.

The encoder 911 includes a processing module 132 and an encoding module 11. A processing module 132 prepares the speech signal for encoding of the encoding module 11 by determination or selection of one or more preferential coding values based on the spectral response associated with the speech signal. At the mobile station 127, the spectral response of the outgoing speech signal may be influenced by one or more of the following factors: (1) frequency response of the microphone 124, (2) position and distance of the microphone 124 with respect to a source (e.g., speaker's mouth) of the audible speech message, and (3) frequency response of an audio stage 134 that amplifies the output of the microphone 124.

A spectral response refers to the energy distribution (e.g., magnitude versus frequency) of the voice signal over at least part of bandwidth of the voice signal. A flat spectral response refers to an energy distribution that is generally evenly distributed over the bandwidth. A sloped spectral response refers to an energy distribution that follows a generally linear or curved contour versus frequency, where the energy distribution is not evenly distributed over the bandwidth.

A first spectral response refers to a voice signal with a sloped spectral response where the higher frequency components have greater amplitude than the lower frequency components of the voice signal. A second spectral response refers to a voice signal where the higher frequency components and the lower frequency components of the voice signal have generally equivalent amplitudes within a defined range of each other.

The spectral response of the outgoing speech signal, which is inputted into the encoder 911, may vary. In one example, the spectral response may be generally flat with respect to most frequencies over the bandwidth of the speech message. In another example, the spectral response may have a generally linear slope that indicates an amplitude that increases with frequency over the bandwidth of the speech message. For instance, an MIRS response has an amplitude that increases with a corresponding increase in frequency over the bandwidth of the speech message.

For an uplink transmission, the processing module 132 of the mobile station 127 determines which reference spectral response most closely resembles the spectral response of the input speech signal, provided at an input of the encoder 911. Once the spectral response of the input signal is determined with respect to the reference spectral response, the processing module 132 may select or determine one or more preferential coding parameter associated with the determined spectral response. The processing module 132 in the mobile station 127 may apply the selection of coding parameters, tailored to the spectral response inputted into the encoder 11, to improve the perceptual quality or spectral uniformity of the speech signal. For example, the processing module 132 may compensate for spectral disparities that might otherwise be introduced into the encoded speech signal because of the relative position of the speaker with respect to the microphone 124 or the frequency response of the audio stage 134.

The encoder 911 reduces redundant information in the speech signal or otherwise reduces a greater volume of data of an input speech signal to a lesser volume of data of an encoded speech signal. The encoder 911 may comprise a coder, a vocoder, a codec, or another device for facilitating efficient transmission of information over the air interface between the mobile station 127 and the base station 112. In one embodiment, the encoder 911 comprises a code-excited linear prediction (CELP) coder or a variant of the CELP coder. In an alternate embodiment, the encoder 911 may comprise a parametric coder, such as a harmonic encoder or a waveform-interpolation encoder. The encoder 911 is coupled to a transmitter 62 for transmitting the coded signal over the air interface to the base station 112.

The base station 112 may include a receiver 128 coupled to a decoder 120. At the base station 112, the receiver 128 receives a transmitted signal transmitted by the transmitter 62. The receiver 128 provides the received speech signal to the decoder 120 for decoding and reproduction on the speaker 126 (i.e., transducer) of the fixed subscriber station 118. A decoder 120 reconstructs a replica or facsimile of the speech message inputted into the microphone 124 of the mobile station 127. The decoder 120 reconstructs the speech message by performing inverse operations on the encoded signal with respect to the encoder 911 of the mobile station 127. The decoder 120 or an affiliated communications device sends the decoded signal over the network to the subscriber station (e.g., fixed subscriber station 118).

For a downlink transmission from the base station 112 to the mobile station 127, a source (e.g., a speaker) at the fixed subscriber station 118 (e.g., a telephone set) may speak into a microphone 124 of the fixed subscriber station 118 to produce a speech message. The fixed subscriber station 118 transmits the speech message over the communications network 117 via one of various alternative communications paths to the base station 112.

Each of the alternate communications paths may provide a different spectral response of the speech signal that is applied to processing module 132 of the base station 112. Three examples of communications paths are shown in FIG. 1 for illustrative purposes, although an actual communications network (e.g., a switched circuit network or a data packet network with a web of telecommunications switches) may contain virtually any number of alternative communication paths. In accordance with a first communications path, a local loop between the fixed subscriber station 118 and a local office of the communications network 117 represents an analog local loop 123, whereas a trunk between the communications network 117 and the telecommunications switch 115 is a digital trunk 119. In accordance with second communications path, the speech signal traverses a digital signal path through synchronous digital hierarchy equipment, which includes a digital local loop 125 and a digital trunk 119 between the communications network 117 and the telecommunications switch 115. In accordance with a third communications path, the speech signal traverses over an analog local loop 123 and an analog trunk 121 (e.g., frequency-division multiplexed trunk) between the communications network 117 and the telecommunications switch 115, for example.

The spectral response of any of the three communications paths may be flat or may be sloped. The slope may or may not be consistent with an MIRS model of a telecommunications system, although the slope may vary from network to network.

For a downlink transmission, the processing module 132 of the base station 112 determines which type of reference spectral response most closely resembles the spectral response of the input speech signal, received via a base station controller 113. The processing module 132 selects coding parameter values to enhance the perceptual quality of the reproduced speech. For example, the processing module 132 may select coding parameter values to improve the spectral uniformity of the spectral response inputted into the encoding module 11 of the base station 112 regardless of the communications path traversed over the communications network 117 between the fixed subscriber station 118 and the base station 112. The encoding module 11 at the base station 112 encodes the speech signal provided by the processing module 132. The transmitter 130 transmits the coded speech signal via an electromagnetic signal to the receiver 222 of the mobile station 127.

In one embodiment, the processing module 132 determines or selects at least one first coding parameter value 166 associated with the first spectral response or at least one second coding parameter value 168 associated with a second spectral response. The processing module 132 determines or selects the at least one first coding parameter value 166 or the at least one second coding parameter value 168 to provide a resultant voice signal with perceptual enhancement for input to an encoding module 11. Accordingly, the encoder 911 consistently reproduces speech in a reliable manner that is relatively independent of the presence of analog portions of a communications network. Further, the above technique facilitates the production of natural-sounding or intelligible speech by the encoder 911 in a consistent manner from call-to-call and from one location to another within a wireless communications service area.

For a downlink transmission, the transmitter 130 transmits an encoded signal over the air interface to a receiver 222 of the mobile station 127. The mobile station 127 includes a decoder 120 coupled to the receiver 222 for decoding the encoded signal. The decoded speech signal may be provided in the form of an audible, reproduced speech signal at a speaker 126 or another transducer of the mobile station 127.

Figure 2B:
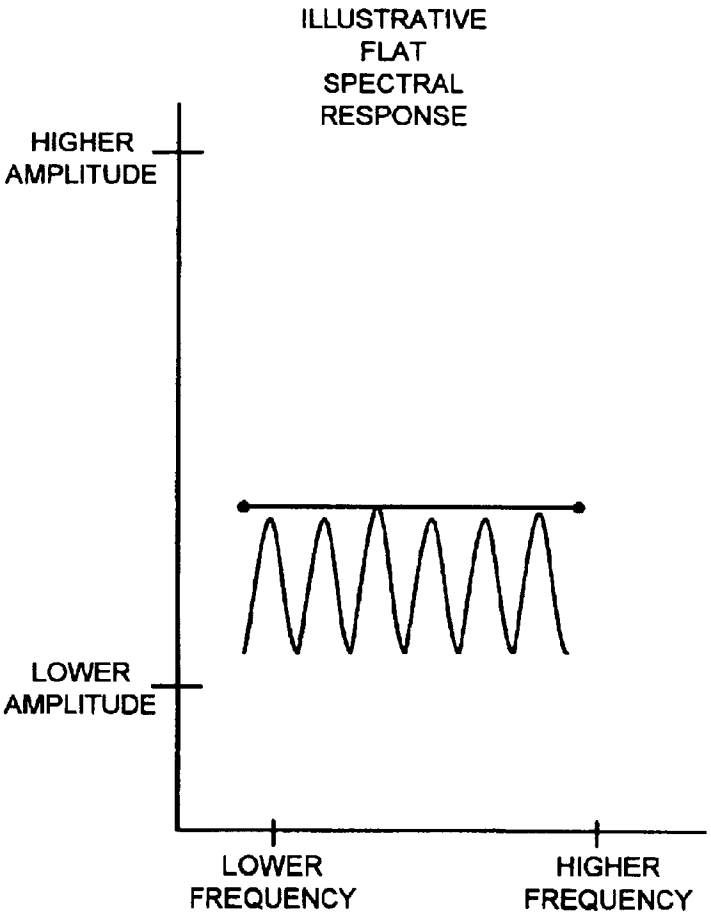
FIG. 2B is a graph of an illustrative flat spectral response of a speech signal with a generally constant amplitude over different frequencies.
Figure 2A:
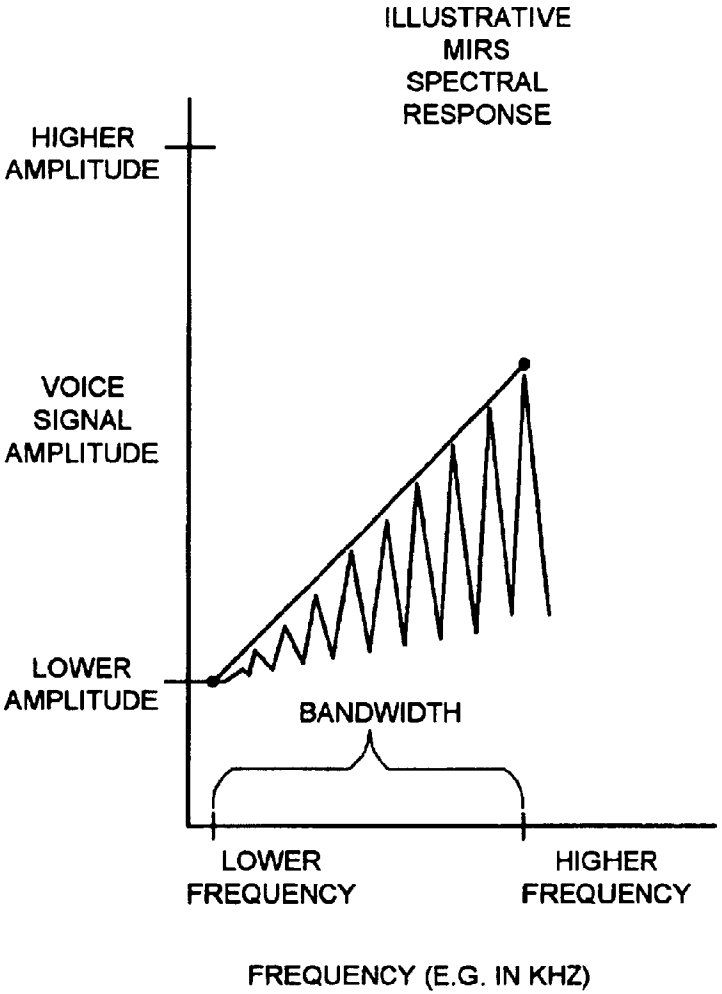
FIG. 2A is a graph of an illustrative sloped spectral response of a speech signal with an amplitude that that increases with a corresponding increase in frequency.

FIG. 2A shows an illustrative graph of a positively sloped spectral response (e.g., MIRS spectral response) associated with a network with at least one analog portion. For example, FIG. 2A may represent the first spectral response, as previously defined herein. The vertical axis represents an amplitude of a voice signal. The horizontal axis represents frequency of the voice signal. The spectral response is sloped or tilted to represent that the amplitude of the voice signal increases with a corresponding increase in the frequency component of the voice signal. The voice signal may have a bandwidth that ranges from a lower frequency to a higher frequency. At the lower frequency, the spectral response has a lower amplitude, while at the higher frequency the spectral response has a higher amplitude. In the context of an MIRS response, the slope shown in FIG. 2A may represent a 6 dB per octave (i.e., a standard measure of change in frequency) slope. Although the slope shown in FIG. 2A is generally linear, in an alternate example of spectral response, the slope may be depicted as a curved slope. Although the slope of FIG. 2A intercepts the peak amplitudes of the speech signal, in an alternate example, the slope may intercept the root mean squared average of the signal amplitude or another baseline value.

FIG. 2B is a graph of a flat spectral response. A flat spectral response may be associated with a network with predominately digital infrastructure. For example, FIG. 2B may represent the second spectral response, as previously defined herein. The vertical axis represents an amplitude of a voice signal. The horizontal axis represents a frequency of the voice signal. The flat spectral response generally has a slope approaching zero, as expressed by the generally horizontal line extending intermediately between the higher amplitude and the lower amplitude. Accordingly, the flat spectral response has approximately the same intermediate amplitude at the lower frequency and the higher frequency. Although the horizontal line intercepts the peak amplitude of the voice signal, in an alternative example, the horizontal line may intercept the root mean squared average of the signal amplitude or another baseline value of the speech signal.

Figure 3:
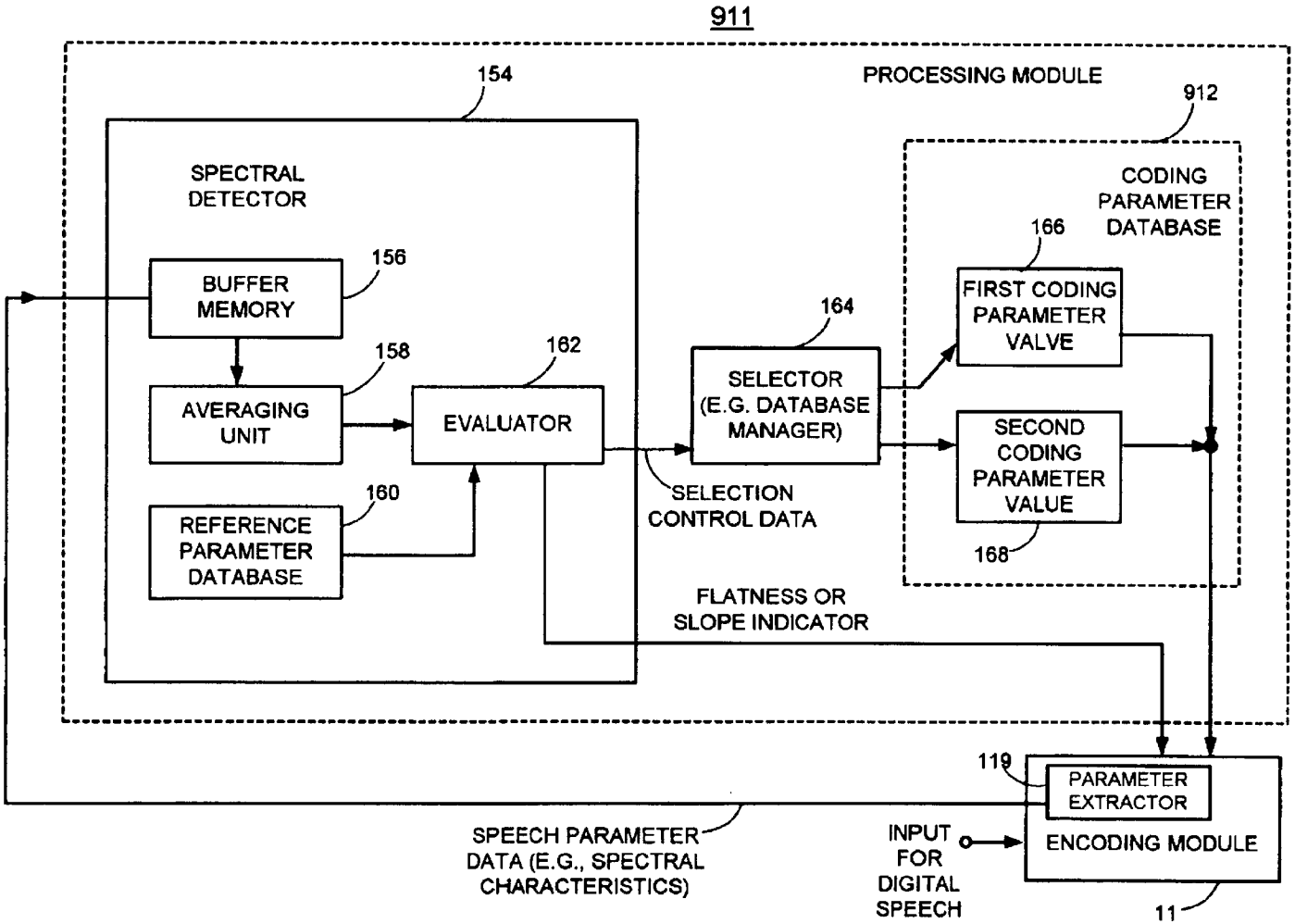
FIG. 3 is a block diagram that shows the processing module of the encoder of FIG. 1 in greater detail.

FIG. 3 is a block diagram of an encoder 911 of FIG. 1. FIG. 3 shows the processing module 132 of the encoder 911 in greater detail than FIG. 1. The processing module 32 includes a spectral detector 154 coupled to a selector 164 (e.g., database manager). In turn, the selector 164 (e.g., database manager) is adapted to select at least one first coding parameter value 166 or at least one second coding parameter value 168 from a coding parameter database 912. At least one first coding parameter value 166 or at least one second coding parameter value 168 are provided to the encoding module 11.

The encoding module 11 includes a parameter extractor 119 for extracting speech parameters from the speech signal inputted into the encoding module 11 from the processing module 132. The speech parameters relate to the spectral characteristics of the speech signal that is inputted into the encoding module 11.

The spectral detector 154 includes buffer memory 156 for receiving the speech parameters as input. The buffer memory 156 stores speech parameters representative of a minimum number of frames of the speech signal or a minimum duration of the speech signal sufficient to accurately evaluate the spectral response or content of the input speech signal.

The buffer memory 156 is coupled to an averaging unit 158 that averages the signal parameters over the minimum duration of the speech signal sufficient to accurately evaluate the spectral response. An evaluator 162 receives the averaged signal parameters from the averaging unit 158 and accesses reference signal parameters from the reference parameter database 160 for comparison. The reference signal parameters may be stored in the reference parameter database 160 or another storage device, such as non-volatile electronic memory. The evaluator 162 compares the averaged signal parameters to the accessed reference signal parameters to produce selection control data for input to the selector 164 (e.g., database manager).

The reference signal parameters represent spectral characteristic data, such a first spectral response, a second spectral response, or any other defined reference spectral response. In accordance with the first spectral response, the higher frequency components have a greater amplitude than the lower frequency components of the voice signal. For example, the first spectral response may conform to a MIRS characteristic, an IRS characteristic, or another standard model that models the spectral response of a channel of a communications network. In accordance with the second spectral response, the higher frequency components and the lower frequency components have generally equivalent amplitudes within a defined range.

The evaluator 162 determines which reference speech parameters most closely match the received speech parameters to identify the closest reference spectral response to the actual spectral response of the speech signal presented to the encoding module 11. The evaluator 162 provides control selection data to the selector 164 (e.g., database manager) for controlling the selection of the selector 164 (e.g., database manager). The control selection data controls the selector 164 (e.g., database manager) to select at least one first coding parameter value 166 (e.g., preferential first coding parameter value) if the received speech parameters are closest to the first spectral response, as opposed to the second spectral response. In contrast, the control selection data controls the selector 164 (e.g., database manager) to select the second coding parameter value 168 (e.g., preferential second coding parameter value) if the received spectral parameters are closest to the second spectral response, as opposed to the first spectral response. The coding parameters and their associated coding parameter values may relate to the characteristics of one or more digital filters of the encoder 911, as is later described in greater detail in conjunction with FIG. 5.

Once the spectral response of the input speech signal is determined, the processing module 132 may determine or select one or more appropriate coding parameter values (e.g., preferential coding parameter values) by referencing a coding parameter database 912. Within the coding parameter database 912, preferential coding values are associated with corresponding spectral responses of the input speech signal. Further, preferential coding values may be affiliated with a filter identifier or encoder component identifier to identify the encoder component or filter to which the preferential coding values apply. A first spectral response is associated with at least one preferential first coding parameter value. Similarly, the second spectral response is associated with at least one preferential second coding parameter value.

In one embodiment, the evaluator 162 provides a flatness or slope indicator on the speech signal to the encoding module 11. The flatness or slope indicator may represent the absolute slope of the spectral response of the received signal, or the degree that the flatness or slope varies from the first spectral response, for example. Accordingly, the evaluator 162 may trigger an adjustment of at least one encoding parameter to a revised encoding parameter based on the degree of flatness or slope of the input speech signal during an encoding process. The encoding parameter is associated with the first coding parameter value 166, the second coding parameter value 168, or both.

The digital signal input of the speech signal is applied to the encoding module 11. The digital signal input may represent an audio stage 134 of a mobile station 127 or an output of a base station controller 113 as shown in FIG. 1. Although the embodiment of FIG. 3 includes one encoding module 11 in an alternate embodiment, the encoder 911 may include multiple encoding modules 11.

Although the embodiment of FIG. 3 includes an encoding module 11 with an input for flatness indicator or a slope indicator of the speech signal, in another alternate embodiment, the input for the flatness indicator or the slope indicator may be omitted. This omission may be present where the encoding module 11 does not adjust any encoding parameters during the encoding procedure based on the detected flatness indicator or the detected slope indicator.

Figure 4:
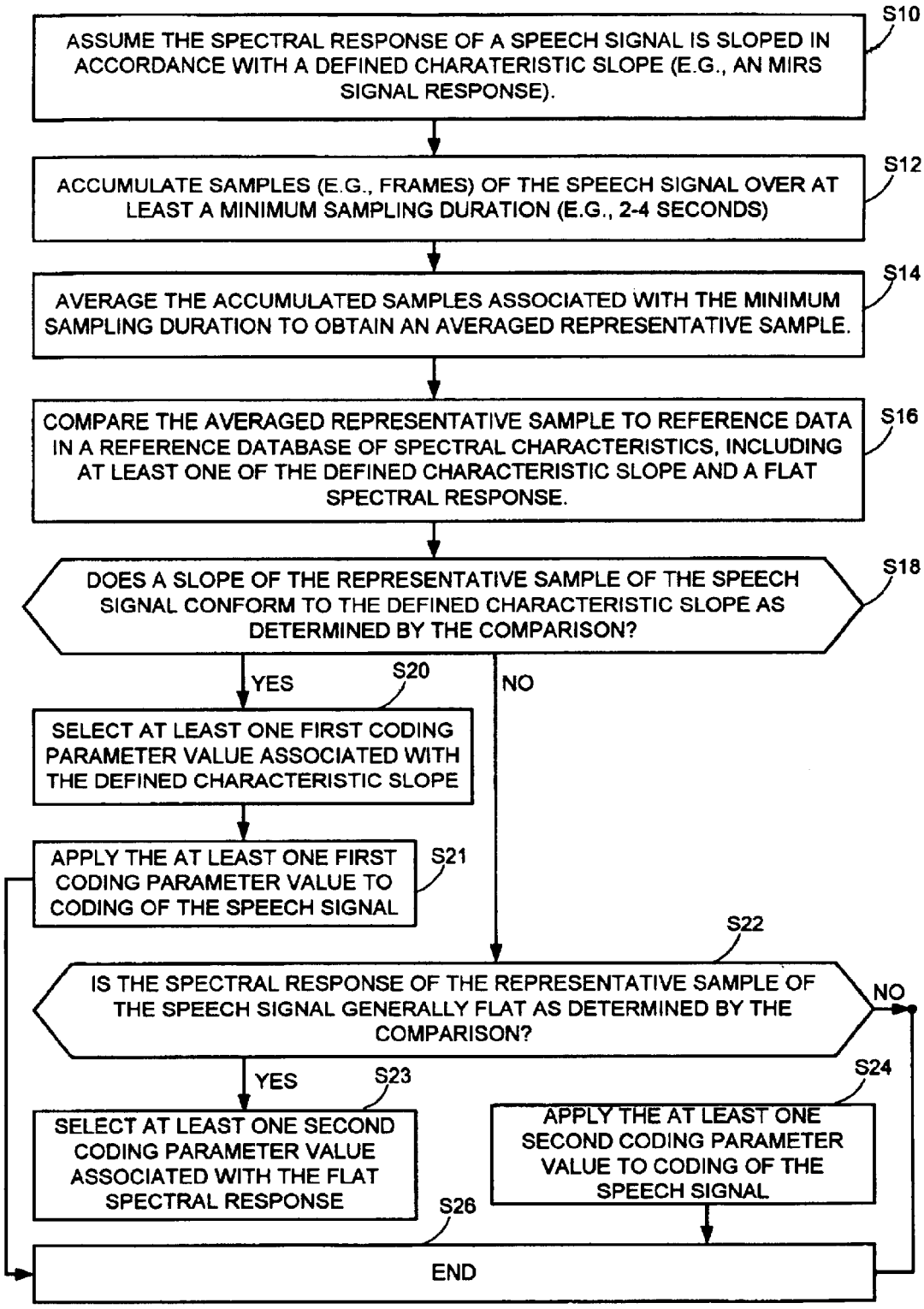
FIG. 4 is a flow chart of a method of selecting preferential values of coding parameters based on a spectral response of an input speech signal.

FIG. 4 shows a method of signal processing in preparation for coding speech. The method of FIG. 4 begins in step S10.

In step S10, during an initial evaluation period, the encoder 911 or the processing module 132 may assume that the spectral response of a speech signal is sloped in accordance with a defined characteristic slope (e.g., a first spectral response or an MIRS signal response). A wireless service operator may adopt the foregoing assumption on the spectral response or may refuse to adopt the foregoing assumption based upon the prevalence of the MIRS signal response in telecommunications infrastructure associated with the wireless server operator's wireless network, for example. A spectral response of the voice signal results from the interaction of the voice signal and its original spectral content with a communications network or another electronic device.

In one embodiment, the processing module 132 may temporarily assume that the spectral response of a speech signal is sloped in accordance with the defined characteristic slope prior to completion of accumulating samples during a minimum sampling period and/or the determining whether the slope of the representative sample of the speech signal actually conforms to the defined characteristic slope. For example, during the initial evaluation period, the evaluator 162 sends a selection control data to the selector 164 (e.g., database manager) to initially invoke at least one first coding parameter value 166 as an initial default coding parameter value for application to speech signal with a defined characteristic slope or an assumed, defined characteristic slope.

The initial evaluation period of step S10 refers to a time period prior to the passage of at least a minimum sampling duration or prior to the accumulation of a minimum number of samples for an accurate determination of the spectral response of the input speech signal. Once the initial evaluation period expires and actual measurements of the spectral response of the speech signal are available, the processing module 132 may no longer assume, without actual verification, that the spectral response of the speech signal is sloped in accordance with the defined characteristic slope.

In an alternate embodiment, the spectral detector 154 preferably determines or verifies whether a voice signal is closest to the defined characteristic slope or another reference spectral response prior to invoking at least one first coding parameter value 166 or the at least one second coding parameter value 168.

In step S12, the processing module 132 (e.g., buffer memory 156) accumulates samples (e.g., frames) of the speech signal or speech parameter data over at least the minimum sampling duration (e.g., 2–4 seconds). For example, a sample may represent an average of the speech signal's amplitude versus frequency response during a frame that is approximately 20 milliseconds long. Accordingly, a minimum sampling period may be expressed as a minimum number of samples (e.g., 100 to 200 samples) which are equivalent to the aforementioned sampling duration.

In step S14, the processing module 132 (e.g., an averaging unit 158 or the spectral detector 154) evaluates the samples or frames associated with the minimum sampling period to provide a statistical expression or representative sample of the frames. For example, the averaging unit 158 averages the accumulated samples associated with the minimum sampling duration to obtain a representative sample or averaged speech parameters.

In step S16, the processing module 132 (e.g., an evaluator 162) accesses a reference parameter database 160 to obtain reference data on a reference amplitude versus frequency response of a reference speech signal during a minimum sampling duration. Further, the evaluator 162 compares the representative sample or the statistical expression to the reference data in the reference parameter database 160. The reference data generally represents an amplitude versus frequency response. The reference data may include one or more of the following items: (1) a defined characteristic slope (e.g., a first spectral response), (2) a flat spectral response (e.g., second spectral response),(3) a target spectral response.

FIG. 2A and FIG. 2B show illustrative examples of the defined characteristic slope and the flat spectral response, respectively. In practice, the defined characteristic slope or the flat spectral response may be defined in accordance with geometric equations or by entries within a look-up table of the reference database.

In step S18, the processing module 132 determines if the slope of the representative sample of the speech signal conforms to the defined characteristic slope within a maximum permissible tolerance in accordance with the comparison of step S16. If the slope of the representative sample conforms to the defined characteristic slope within the maximum permissible tolerance, then the method continues with step S20. If the slope of the representative sample does not conform to the defined characteristic slope, then the method continues with step S22.

In step S20, which may occur after step S18, the selector 164 (e.g., database manager) selects or determines at least one first coding parameter value associated with the defined characteristic slope. For example, the selector 164 may access the coding parameter database 912 and retrieve a preferential first coding parameter value associated with the defined characteristic slope. A preferential coding parameter value refers to at least one first coding parameter value or at least one second coding parameter value that enhances perceptual quality and/or consistency or a reproduced speech signal by consideration of the spectral content of an input speech signal.

Step S21 follows step S20. In step S21, the processing module 132 may apply at least one first coding parameter value 166 to coding of speech in the encoding module 11. For example, the selector 164 or the database manager may send a first coding parameter value 166 from the coding parameter database 912 to the encoding module 11. Here, the coding may refer to encoding of the speech signal by the encoder 911 , decoding of the speech signal by the decoder 120 or both. Step S26 follows step S21; the method ends in step S26.

In step S22, the processing module 132 determines if the spectral response of the representative sample of the speech signal is generally flat within a maximum permissible tolerance in accordance with the comparison of step S16. If the spectral response of the representative sample is generally flat within a maximum permissible tolerance, then the method continues with step S23. If the spectral response of the representative speech signal is sloped or not sufficiently flat, the method ends in step S26.

In step S23, which may occur after step S22, the selector 164 (e.g., database manager) selects or determines at least one second coding parameter value associated with the flat spectral response. For example, the selector 164 may access the coding parameter database 912 and retrieve a preferential second coding parameter value associated with the flat spectral response.

Step S24 follows step S23. In step S24, the processing module 132 applies a second coding parameter value 168 to coding of the speech. For example, the selector 164 or the database manager may send a second coding parameter value 168 from the coding parameter database 912 to the encoding module 11, which encodes the input speech signal to output an encoded speech signal. Here, the coding may refer to encoding of the speech signal by the encoder 911, decoding of the speech signal by the decoder 120 or both. Step S26 follows step S21; the method ends in step S26.

The method of FIG. 4 promotes spectral uniformity in coding of the speech signal that is inputted into the coder (e.g., encoding module 11). The processing module 132 adjusts the coding parameters or selects preferential encoding values to support a coding process that yields a perceptually superior reproduction of speech.

The selecting of coding parameter values in step S20 and S23 may be carried out in accordance with several alternative techniques, which to some extent depend upon whether the speech is being encoded or decoded. In the context of encoding, the selecting of step S20 and S23 may include selecting preferential parameter coding values for one or more of the following encoding parameters: (1) pitch gains per frame or subframe, (2) at least one weighting filter coefficient of a perceptual weighting filter in the encoder, (3) at least one bandwidth expansion constant associated with filter coefficients of a synthesis filter (e.g., short-term predictive filter) of the encoding module 11, and (4) at least one bandwidth expansion constant associated with filter coefficients of an analysis filter of the encoding module 11 to support a desired level of quality of perception of the reproduced speech. For encoding, the evaluator 162 may provide control data or a spectral-content indicator (e.g., flatness or slope indicator) for adjustment or selection of encoding parameters that are consistent with the detection of the first spectral response or the second spectral response of the input speech signal.

In the context of decoding, the selecting of step S20 or step S23 may include selecting at least one preferential coding parameter value for one or more of the following decoding parameters: (1) at least one bandwidth expansion constant associated with a synthesis filter of a decoder and (2) at least one linear predictive filter coefficient associated with a post filter. For decoding, the evaluator 162 may provide a spectral-content indicator (e.g., flatness or slope indicator or another spectral-content indicator) for adjustment or selection of preferential decoding parameter values that are consistent with the selection of the first spectral response or the second spectral response of the input speech signal. For example, the evaluator 162 associated with the encoder 911 may provide a spectral-content indicator for transmission over an air interface to the decoder 120 so that the decoder 120 may apply decoding parameters to the encoded speech without first decoding the speech to evaluate the spectral content of the speech. Similarly, the evaluator 162 may provide a spectral-content indicator for transmission over the air interface to the decoder 120 so that the post-filter 71 may apply filtering parameters consistent with the spectral response of the encoded speech signal without first decoding the coded speech signal to determine the spectral content of the coded speech signal.

In an alternative embodiment, the decoder 120 is associated with a detector for detecting the spectral content of the speech signal after decoding the encoded speech signal. Further, the detector provides a spectral-content indicator as feedback to the decoder 120, the post filter 71, or both for selecting of decoding or filtering parameters, respectively.

The evaluator 162 is coupled to a coder (e.g., encoding module 11). The evaluator 162 is capable of sending a flatness indicator or a slope indicator to the coder (e.g., encoding module 11) that indicates whether or not the speech signal is sloped or the degree of such slope. The flatness indicator or slope indicator may be used to determine an adjusted value for the pitch gains, the weighting filter coefficients and the linear predictive coding bandwidth expansion, or another applicable coding parameter. For example, the bandwidth expansion of a speech signal may be adjusted to change a value of a linear predictive filter for a synthesis filter or an analysis filter from a previous value based on a degree of slope or flatness in the speech signal.

The pitch gain value may be selected as a first coding parameter value, a second coding parameter value, or a preferential coding parameter value to enhance a perceptual representation of the derived speech signal that is closer to a target signal. The coder (e.g., encoding module 11) determines pitch gain of a frame during a preprocessing stage prior to encoding the frame. The coder (e.g., encoding module 11) estimates the pitch gain to minimize a mean-squared error between a target speech signal and a derived speech signal (e.g., warped, modified speech signal). The pitch gains are preferably quantized. The first gain adjuster 38 (FIG. 5) or the second gain adjuster 52 (FIG. 5) may refer to a codebook of quantized entries of pitch gain. The pitch gain may be updated on a frame-by-frame basis, a sub-frame-by-sub-frame basis, or otherwise.

The coder (e.g., encoding module 11) may apply perceptual weighting the speech signal by the application of the first coding parameter value 166 or the second coding parameter value 168 as coefficients of a perceptual weighting filter of the encoding module 11. Perceptual weighting manipulates an envelope of the speech signal to mask noise that would otherwise be heard by a listener. The perceptual weighting includes a filter with a response that compresses the amplitude of the speech signal to reduce fading regions of the speech signal with unacceptable low signal-to-noise. The coefficients of the perceptual weighting filter may be adjusted to reduce a listener's perception of noise based on a detected slope or flatness of the speech signal, as indicated by the flatness indicator or the slope indicator.

Figure 5:
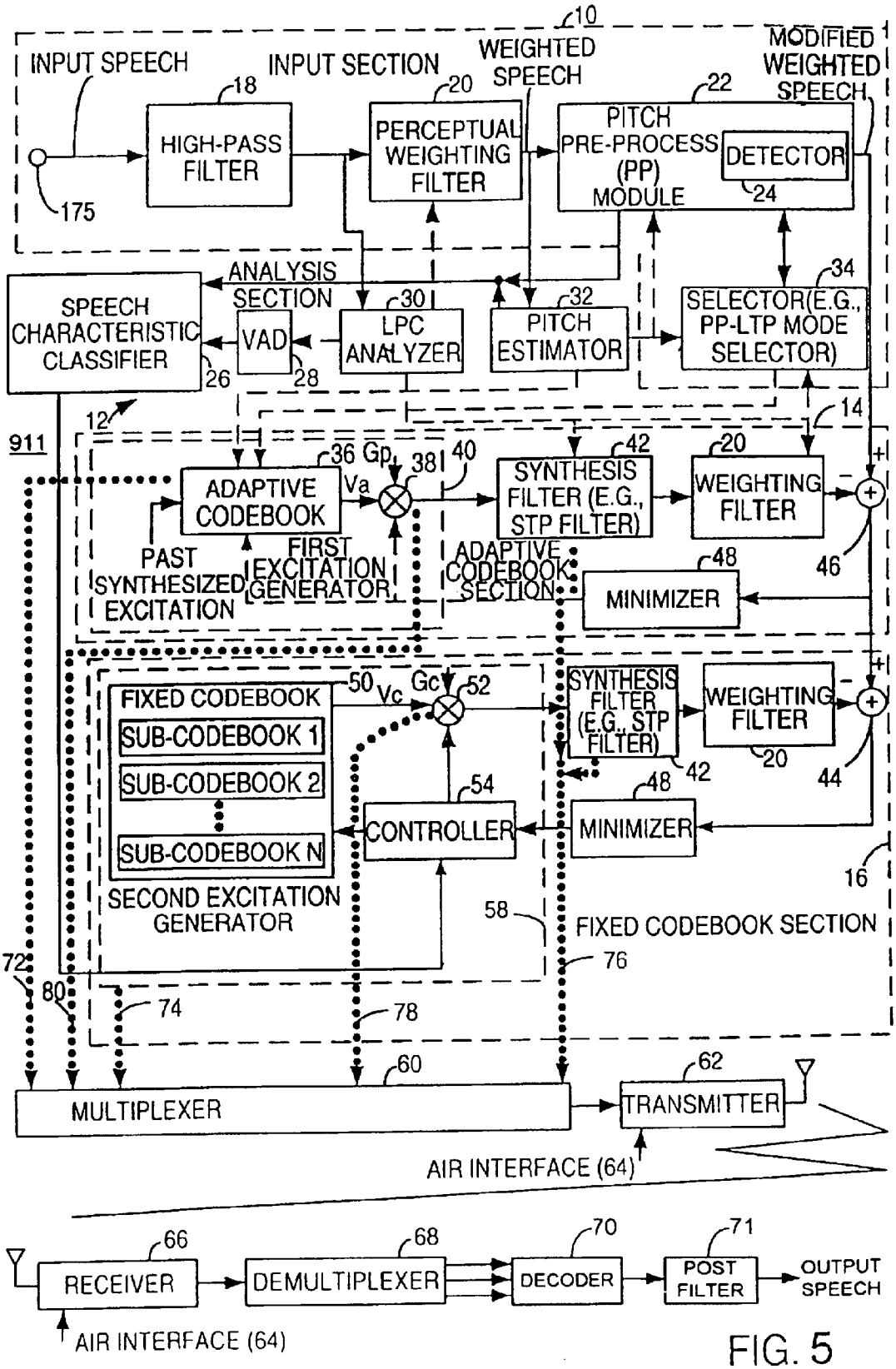
FIG. 5 is a block diagram that shows an encoding module of FIG. 1 and FIG. 3 in greater detail.

FIG. 5 shows an illustrative embodiment of the encoder 911 including an input section 10 coupled to an analysis section 12 and an adaptive codebook section 14. In turn, the adaptive codebook section 14 is coupled to a fixed codebook section 16. A multiplexer 60, associated with both the adaptive codebook section 14 and the fixed codebook section 16, is coupled to a transmitter 62.

The transmitter 62 and a receiver 128 along with a communications protocol represent an air interface 64 of a wireless system. The input speech from a source or speaker is applied to the encoding module 11 at the encoding site. The transmitter 62 transmits an electromagnetic signal (e.g., radio frequency or microwave signal) from an encoding site to a receiver 128 at a decoding site, which is remotely situated from the encoding site. The electromagnetic signal is modulated with reference information representative of the input speech signal. A demultiplexer 68 demultiplexes the reference information for input to the decoder 120. The decoder 120 produces a replica or representation of the input speech, referred to as output speech, at the decoder 120.

The input section 10 has an input terminal for receiving an input speech signal. The input terminal feeds a high-pass filter 18 that attenuates the input speech signal below a cut-off frequency (e.g., 80 Hz) to reduce noise in the input speech signal. The high-pass filter 18 feeds a perceptual weighting filter 20 and a linear predictive coding (LPC) analyzer 30. The perceptual weighting filter 20 may feed both a pitch pre-processing module 22 and a pitch estimator 32. Further, the perceptual weighting filter 20 may be coupled to an input of a first summer 46 via the pitch pre-processing module 22. The pitch pre-processing module 22 includes a detector 24 for detecting a triggering speech characteristic.

In one embodiment, the detector 24 may refer to a classification unit that (1) identifies noise-like unvoiced speech and (2) distinguishes between non-stationary voiced and stationary voiced speech in an interval of an input speech signal. The detector 24 may detect or facilitate detection of the presence or absence of a triggering characteristic (e.g., a generally voiced and generally stationary speech component) in an interval of input speech signal. In another embodiment, the detector 24 may be integrated into both the pitch pre-processing module 22 and the speech characteristic classifier 26 to detect a triggering characteristic in an interval of the input speech signal. In yet another embodiment, the detector 24 is integrated into the speech characteristic classifier 26, rather than the pitch pre-processing module 22. Where the detector 24 is so integrated, the speech characteristic classifier 26 is coupled to a selector 34.

The analysis section 12 includes the LPC analyzer 30, the pitch estimator 32, a voice activity detector 28, and a speech characteristic classifier 26. The LPC analyzer 30 is coupled to the voice activity detector 28 for detecting the presence of speech or silence in the input speech signal. The pitch estimator 32 is coupled to a mode selector 34 for selecting a pitch pre-processing procedure or a responsive long-term prediction procedure based on input received from the detector 24.

The adaptive codebook section 14 includes a first excitation generator 40 coupled to a synthesis filter 42 (e.g., short-term predictive filter). In turn, the synthesis filter 42 feeds a perceptual weighting filter 20. The weighting filter 20 is coupled to an input of the first summer 46, whereas a minimizer 48 is coupled to an output of the first summer 46. The minimizer 48 provides a feedback command to the first excitation generator 40 to minimize an error signal at the output of the first summer 46. The adaptive codebook section 14 is coupled to the fixed codebook section 16 where the output of the first summer 46 feeds the input of a second summer 44 with the error signal.

The fixed codebook section 16 includes a second excitation generator 58 coupled to a synthesis filter 42 (e.g., short-term predictive filter). In turn, the synthesis filter 42 feeds a perceptual weighting filter 20. The weighting filter 20 is coupled to an input of the second summer 44, whereas a minimizer 48 is coupled to an output of the second summer 44. A residual signal is present on the output of the second summer 44. The minimizer 48 provides a feedback command to the second excitation generator 58 to minimize the residual signal.

In one alternate embodiment, the synthesis filter 42 and the perceptual weighting filter 20 of the adaptive codebook section 14 are combined into a single filter.

In another alternate embodiment, the synthesis filter 42 and the perceptual weighting filter 20 of the fixed codebook section 16 are combined into a single filter. In yet another alternate embodiment, the three perceptual weighting filters 20 of the encoder may be replaced by two perceptual weighting filters 20, where each perceptual weighting filter 20 is coupled in tandem with the input of one of the minimizers 48. Accordingly, in the foregoing alternate embodiment the perceptual weighting filter 20 from the input section 10 is deleted.

In accordance with FIG. 5, an input speech signal is inputted into the input section 10. The input section 10 decomposes speech into component parts including (1) a short-term component or envelope of the input speech signal, (2) a long-term component or pitch lag of the input speech signal, and (3) a residual component that results from the removal of the short-term component and the long-term component from the input speech signal. The encoding module 11 uses the long-term component, the short-term component, and the residual component to facilitate searching for the preferential excitation vectors of the adaptive codebook 36 and the fixed codebook 50 to represent the input speech signal as reference information for transmission over the air interface 64.

The perceptual weighing filter 20 of the input section 10 has a first time versus amplitude response that opposes a second time versus amplitude response of the formants of the input speech signal. The formants represent key amplitude versus frequency responses of the speech signal that characterize the speech signal consistent with an linear predictive coding analysis of the LPC analyzer 30. The perceptual weighting filter 20 is adjusted to compensate for the perceptually induced deficiencies in error minimization, which would otherwise result, between the reference speech signal (e.g., input speech signal) and a synthesized speech signal.

The input speech signal is provided to a linear predictive coding (LPC) analyzer 30 (e.g., LPC analysis filter) to determine LPC coefficients for the synthesis filters 42 (e.g., short-term predictive filters). The input speech signal is inputted into a pitch estimator 32. The pitch estimator 32 determines a pitch lag value and a pitch gain coefficient for voiced segments of the input speech. Voiced segments of the input speech signal refer to generally periodic waveforms.

The pitch estimator 32 may perform an open-loop pitch analysis at least once a frame to estimate the pitch lag. Pitch lag refers a temporal measure of the repetition component (e.g., a generally periodic waveform) that is apparent in voiced speech or voice component of a speech signal. For example, pitch lag may represent the time duration between adjacent amplitude peaks of a generally periodic speech signal. As shown in FIG. 5, the pitch lag may be estimated based on the weighted speech signal. Alternatively, pitch lag may be expressed as a pitch frequency in the frequency domain, where the pitch frequency represents a first harmonic of the speech signal.

The pitch estimator 32 maximizes the correlations between signals occurring in different sub-frames to determine candidates for the estimated pitch lag. The pitch estimator 32 preferably divides the candidates within a group of distinct ranges of the pitch lag. After normalizing the delays among the candidates, the pitch estimator 32 may select a representative pitch lag from the candidates based on one or more of the following factors: (1) whether a previous frame was voiced or unvoiced with respect to a subsequent frame affiliated with the candidate pitch delay; (2) whether a previous pitch lag in a previous frame is within a defined range of a candidate pitch lag of a subsequent frame, and (3) whether the previous two frames are voiced and the two previous pitch lags are within a defined range of the subsequent candidate pitch lag of the subsequent frame. The pitch estimator 32 provides the estimated representative pitch lag to the adaptive codebook 36 to facilitate a starting point for searching for the preferential excitation vector in the adaptive codebook 36. The adaptive codebook section 11 later refines the estimated representative pitch lag to select an optimum or preferential excitation vector from the adaptive codebook 36.

The speech characteristic classifier 26 preferably executes a speech classification procedure in which speech is classified into various classifications during an interval for application on a frame-by-frame basis or a subframe-by-subframe basis. The speech classifications may include one or more of the following categories: (1) silence/background noise, (2) noise-like unvoiced speech, (3) unvoiced speech, (4) transient onset of speech, (5) plosive speech, (6) non-stationary voiced, and (7) stationary voiced. Stationary voiced speech represents a periodic component of speech in which the pitch (frequency) or pitch lag does not vary by more than a maximum tolerance during the interval of consideration. Non-stationary voiced speech refers to a periodic component of speech where the pitch (frequency) or pitch lag varies more than the maximum tolerance during the interval of consideration. Noise-like unvoiced speech refers to the nonperiodic component of speech that may be modeled as a noise signal, such as Gaussian noise. The transient onset of speech refers to speech that occurs immediately after silence of the speaker or after low amplitude excursions of the speech signal. A speech classifier may accept a raw input speech signal, pitch lag, pitch correlation data, and voice activity detector data to classify the raw speech signal as one of the foregoing classifications for an associated interval, such as a frame or a subframe. The foregoing speech classifications may define one or more triggering characteristics that may be present in an interval of an input speech signal. The presence or absence of a certain triggering characteristic in the interval may facilitate the selection of an appropriate encoding scheme for a frame or subframe associated with the interval.

A first excitation generator 40 includes an adaptive codebook 36 and a first gain adjuster 38 (e.g., a first gain codebook). A second excitation generator 58 includes a fixed codebook 50, a second gain adjuster 52 (e.g., second gain codebook), and a controller 54 coupled to both the fixed codebook 50 and the second gain adjuster 52. The fixed codebook 50 and the adaptive codebook 36 define excitation vectors. Once the LPC analyzer 30 determines the filter parameters of the synthesis filters 42, the encoding module 11 searches the adaptive codebook 36 and the fixed codebook 50 to select proper excitation vectors. The first gain adjuster 38 may be used to scale the amplitude of the excitation vectors of the adaptive codebook 36. The second gain adjuster 52 may be used to scale the amplitude of the excitation vectors in the fixed codebook 50. The controller 54 uses speech characteristics from the speech characteristic classifier 26 to assist in the proper selection of preferential excitation vectors from the fixed codebook 50, or a sub-codebook therein.

The adaptive codebook 36 may include excitation vectors that represent segments of waveforms or other energy representations. The excitation vectors of the adaptive codebook 36 may be geared toward reproducing or mimicking the long-term variations of the speech signal. A previously synthesized excitation vector of the adaptive codebook 36 may be inputted into the adaptive codebook 36 to determine the parameters of the present excitation vectors in the adaptive codebook 36. For example, the encoder may alter the present excitation vectors in its codebook in response to the input of past excitation vectors outputted by the adaptive codebook 36, the fixed codebook 50, or both. The adaptive codebook 36 is preferably updated on a frame-by-frame or a subframe-by-subframe basis based on a past synthesized excitation, although other update intervals may produce acceptable results and fall within the scope of the invention.

The excitation vectors in the adaptive codebook 36 are associated with corresponding adaptive codebook indices. In one embodiment, the adaptive codebook indices may be equivalent to pitch lag values. The pitch estimator 32 initially determines a representative pitch lag in the neighborhood of the preferential pitch lag value or preferential adaptive index. A preferential pitch lag value minimizes an error signal at the output of the first summer 46, consistent with a codebook search procedure. The granularity of the adaptive codebook index or pitch lag is generally limited to a fixed number of bits for transmission over the air interface 64 to conserve spectral bandwidth. Spectral bandwidth may represent the maximum bandwidth of electromagnetic spectrum permitted to be used for one or more channels (e.g., downlink channel, an uplink channel, or both) of a communications system. For example, the pitch lag information may need to be transmitted in 7 bits for half-rate coding or 8-bits for full-rate coding of voice information on a single channel to comply with bandwidth restrictions. Thus, 128 states are possible with 7 bits and 256 states are possible with 8 bits to convey the pitch lag value used to select a corresponding excitation vector from the adaptive codebook 36.

The encoding module 11 may apply different excitation vectors from the adaptive codebook 36 on a frame-by-frame basis or a subframe-by-subframe basis. Similarly, the filter coefficients of one or more synthesis filters 42 may be altered or updated on a frame-by-frame basis. However, the filter coefficients preferably remain static during the search for or selection of each preferential excitation vector of the adaptive codebook 36 and the fixed codebook 50. In practice, a frame may represent a time interval of approximately 20 milliseconds and a sub-frame may represent a time interval within a range from approximately 5 to 10 milliseconds, although other durations for the frame and sub-frame fall within the scope of the invention.

The adaptive codebook 36 is associated with a first gain adjuster 38 for scaling the gain of excitation vectors in the adaptive codebook 36. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The first excitation generator 40 is coupled to a synthesis filter 42. The first excitation vector generator 40 may provide a long-term predictive component for a synthesized speech signal by accessing appropriate excitation vectors of the adaptive codebook 36. The synthesis filter 42 outputs a first synthesized speech signal based upon the input of a first excitation signal from the first excitation generator 40. In one embodiment, the first synthesized speech signal has a long-term predictive component contributed by the adaptive codebook 36 and a short-term predictive component contributed by the synthesis filter 42.

The first synthesized signal is compared to a weighted input speech signal. The weighted input speech signal refers to an input speech signal that has at least been filtered or processed by the perceptual weighting filter 20. As shown in FIG. 5, the first synthesized signal and the weighted input speech signal are inputted into a first summer 46 to obtain an error signal. A minimizer 48 accepts the error signal and minimizes the error signal by selecting (i.e., searching for and applying) the preferential selection of an excitation vector in the adaptive codebook 36, by selecting a preferential selection of the first gain adjuster 38 (e.g., first gain codebook), or by selecting both of the foregoing selections. A preferential selection of the excitation vector and the gain scalar (or gain vector) apply to a subframe or an entire frame of transmission to the decoder 120 over the air interface 64. The filter coefficients of the synthesis filter 42 remain fixed during the adjustment or search for each distinct preferential excitation vector and gain vector.

The second excitation generator 58 may generate an excitation signal based on selected excitation vectors from the fixed codebook 50. The fixed codebook 50 may include excitation vectors that are modeled based on energy pulses, pulse position energy pulses, Gaussian noise signals, or any other suitable waveforms. The excitation vectors of the fixed codebook 50 may be geared toward reproducing the short-term variations or spectral envelope variation of the input speech signal. Further, the excitation vectors of the fixed codebook 50 may contribute toward the representation of noise-like signals, transients, residual components, or other signals that are not adequately expressed as long-term signal components.

The excitation vectors in the fixed codebook 50 are associated with corresponding fixed codebook indices 74. The fixed codebook indices 74 refer to addresses in a database, in a table, or references to another data structure where the excitation vectors are stored. For example, the fixed codebook indices 74 may represent memory locations or register locations where the excitation vectors are stored in electronic memory of the encoding module 11.

The fixed codebook 50 is associated with a second gain adjuster 52 for scaling the gain of excitation vectors in the fixed codebook 50. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The second excitation generator 58 is coupled to a synthesis filter 42 (e.g., short-term predictive filter), which may be referred to as a linear predictive coding (LPC) filter. The synthesis filter 42 outputs a second synthesized speech signal based upon the input of an excitation signal from the second excitation generator 58. As shown, the second synthesized speech signal is compared to a difference error signal outputted from the first summer 46. The second synthesized signal and the difference error signal are inputted into the second summer 44 to obtain a residual signal at the output of the second summer 44. A minimizer 48 accepts the residual signal and minimizes the residual signal by selecting (i.e., searching for and applying) the preferential selection of an excitation vector in the fixed codebook 50, by selecting a preferential selection of the second gain adjuster 52 (e.g., second gain codebook), or by selecting both of the foregoing selections. A preferential selection of the excitation vector and the gain scalar (or gain vector) apply to a subframe or an entire frame. The filter coefficients of the synthesis filter 42 remain fixed during the adjustment.

The LPC analyzer 30 provides filter coefficients for the synthesis filter 42 (e.g., short-term predictive filter). For example, the LPC analyzer 30 may provide filter coefficients based on the input of a reference excitation signal (e.g., no excitation signal) to the LPC analyzer 30. Although the difference error signal is applied to an input of the second summer 44, in an alternate embodiment, the weighted input speech signal may be applied directly to the input of the second summer 44 to achieve substantially the same result as described above.

The preferential selection of a vector from the fixed codebook 50 preferably minimizes the quantization error among other possible selections in the fixed codebook 50. Similarly, the preferential selection of an excitation vector from the adaptive codebook 36 preferably minimizes the quantization error among the other possible selections in the adaptive codebook 36. Once the preferential selections are made in accordance with FIG. 5, a multiplexer 60 multiplexes the fixed codebook index 74, the adaptive codebook index 72, the first gain indicator (e.g., first codebook index), the second gain indicator (e.g., second codebook gain), and the filter coefficients associated with the selections to form reference information. The filter coefficients may include filter coefficients for one or more of the following filters: at least one of the synthesis filters 42, the perceptual weighing filter 20 and other applicable filter.

A transmitter 62 or a transceiver is coupled to the multiplexer 60. The transmitter 62 transmits the reference information from the encoding module 11 to a receiver 128 via an electromagnetic signal (e.g., radio frequency or microwave signal) of a wireless system as illustrated in FIG. 5. The multiplexed reference information may be transmitted to provide updates on the input speech signal on a subframe-by-subframe basis, a frame-by-frame basis, or at other appropriate time intervals consistent with bandwidth constraints and perceptual speech quality goals.

The receiver 128 is coupled to a demultiplexer 68 for demultiplexing the reference information. In turn, the demultiplexer 68 is coupled to a decoder 120 for decoding the reference information into an output speech signal. As shown in FIG. 5, the decoder 120 receives reference information transmitted over the air interface 64 from the encoding module 11. The decoder 120 uses the received reference information to create a preferential excitation signal. The reference information facilitates accessing of a duplicate adaptive codebook and a duplicate fixed codebook to those at the encoder 70. One or more excitation generators of the decoder 120 apply the preferential excitation signal to a duplicate synthesis filter. The same values or approximately the same values are used for the filter coefficients at both the encoding module 11 and the decoder 120. The output speech signal obtained from the contributions of the duplicate synthesis filter and the duplicate adaptive codebook is a replica or representation of the input speech inputted into the encoding module 11. Thus, the reference data is transmitted over an air interface 64 in a bandwidth efficient manner because the reference data is composed of less bits, words, or bytes than the original speech signal inputted into the input section 10.

In an alternate embodiment, certain filter coefficients are not transmitted from the encoder to the decoder, where the filter coefficients are established in advance of the transmission of the speech information over the air interface 64 or are updated in accordance with internal symmetrical states and algorithms of the encoder and the decoder.

The synthesis filter 42 (e.g., a short-term synthesis filter) may have a response that generally conforms to the following equation:

$$\frac{1}{A(z)} = \frac{1}{1 - \sum_{i=1}^{P} a_{irevisedZ^{-1}}},$$

where 1/A(z) is the filter response represented by a z transfer function, $a_{i\ revised}$ is a linear predictive coefficient, i=1 . . . P, and P is the prediction or filter order of the synthesis filter. Although the foregoing filter response may be used, other filter responses for the synthesis filter 42 may be used. For example, the above filter response may be modified to include weighting or other compensation for input speech signals.

If the response of the synthesis filter 42 of the encoding module 11 is expressed as 1/A(z), a response of a corresponding analysis filter of the decoder 120 or the LPC analyzer 30 is expressed as A(z). Thus, the same or similar bandwidth expansion constants or filter coefficients may be applied to a synthesis filter 42, a corresponding analysis filter, or both.

The LPC analyzer 30 may include an LPC bandwidth expander. In one embodiment, the LPC analyzer 30 receives a flatness or slope indicator of the speech signal from the evaluator 162 in the processing module 132. The LPC bandwidth expander or the LPC analyzer 30 may follow the following equation:

$a_{i\ revised}=a_{i\ previous}\gamma^{1}$, where $a_{i\ revised}$ is a revised linear predictive coefficient, $a_{i\ previous}$ is a previous linear predictive coefficient, γ is the bandwidth expansion constant, i=1 . . . P, and P is the prediction order of a synthesis filter or analysis filter of the encoding module 11. In the foregoing equation, $a_{i\ previous}$ represents a member of the set of extracted linear predictive coefficients $\{a_{i\ previous}\}^{P}_{i=1}$, for the synthesis filter 42 of the encoding module 11 or an analysis filter. In one embodiment, γ is set to a first value (e.g., 0.99) if the generally sloped response is consistent with MIRS speech or a first spectral response. Similarly, in one embodiment, γ is set to a second value (e.g., 0.995) for input speech with a generally flat input signal or a second spectral response.

The revised linear predictive coefficient $a_{i\ revised}$ incorporates the bandwidth expansion constant γ into the filter response 1/A(z) of the synthesis filter 42 to provide a desired degree of bandwidth expansion based on the degree of flatness or slope of the input speech signal. The bandwidth expander applies the revised linear predictive coefficients to one or more synthesis filters 42 on a frame-by frame or subframe-by-subframe basis.

The encoder 911 may encode speech differently by controlling the value of the bandwidth expansion constant in accordance with differences in the detected spectral characteristics of the input speech. Here, a first value of the bandwidth expansion constant is an example of the first coding parameter value consistent with step S20 of FIG. 4. For example, the processing module 132 may assign the first value of the bandwidth expansion constant for a defined characteristic slope in step S20. A second value of the bandwidth expansion constant is an example of a second coding parameter value as set forth in step S23. For example, the processing module 132 may assign the second value of the bandwidth expansion constant for a generally flat spectral response, where the first value differs from the second value. If the spectral response is regarded as generally sloped in accordance with a defined characteristic slope (e.g., first spectral response), the linear predictive bandwidth expander may use the first value of bandwidth expansion constant (e.g., $\gamma$=0.99). On the other hand, if the spectral response is regarded as generally flat (e.g., second spectral response), the linear predictive bandwidth expander may use the second value of bandwidth expansion constant (e.g., $\gamma$=0.995) distinct from the first value of the bandwidth expansion constant.

The encoder 911 may encode speech differently by controlling weighting constants of one or more perceptual weighting filters 20 in accordance with differences in the detected spectral characteristics of the input speech. If the spectral response is regarded as generally sloped in accordance with a defined characteristic slope (e.g., first spectral response), the perceptual weighting filter 20 may use a first value for the weighting constant (e.g., $\alpha$=0.2). On the other hand, if the spectral response is regarded as generally flat (e.g., second spectral response), the perceptual weighting filter 20 may use a second value for the weighting constant (e.g., $\alpha$=0) distinct from the first bandwidth constant. The first value of the weighting constant is one example of a first coding parameter value consistent with step S20 of FIG. 4. The second value of the weighting constant is one example of the second coding parameter value as set forth in step S23.

The frequency response of the perceptual weighting filter 20 may be expressed generally as the following equation:

$$W(z) = \frac{1}{1-\alpha z^{-1}} \frac{1+\sum_{i=1}^{P} a_i \rho^i z^{-1}}{1+\sum_{i=1}^{P} a_i \beta^i z^{-1}}$$

where $\alpha$ is a weighting constant, $\rho$ and $\beta$ are preset coefficients (e.g., values from 0 to 1), P is the predictive order or the filter order of the perceptual weighting filter 20, and $\{a_i\}$ is the linear predictive coding coefficient. The perceptual weighting filter 20 controls the value of $\alpha$ based on the spectral response of the input speech signal.

For example, in the selecting step S20 or step S23 of FIG. 4, different values of the weighting constant $\alpha$ may be selected to adjust the frequency response of the perceptual weighting filter in response to the determined slope or flatness of the speech signal. In one embodiment, $\alpha$ approximately equals 0.2 for generally sloped input speech consistent with the MIRS spectral response or a first spectral response. Similarly, in one embodiment $\alpha$ approximately equals 0 for an input speech signal with a generally flat signal response or a second spectral response.

The decoder 120 may be associated with the application of different post-filtering to encoded speech in accordance with differences in the detected spectral characteristics of the input speech. As shown in FIG. 5, the post filter 71 may be coupled to the output of the decoder 120 or otherwise incorporated into the coding system of the invention. If the spectral response of the input speech signal is regarded as generally sloped in accordance with a defined characteristic slope (e.g., the first spectral response), the post filter may use a first set of values for the post-filtering constants (e.g., $\gamma_1$=0.65 and $\gamma_2$=0.4). On the other hand, if the spectral response is regarded as generally flat (e.g., the second spectral response), the post filter may use a second set of values for the post-filtering weighting constants (e.g., $\gamma_1$=0.63 and $\gamma_2$=0.4) distinct from the first set of values of the post-filtering weighting constants. The first set of post-filtering weighting constants are one example of at least one first coding parameter value consistent with step S20 of FIG. 4. The second set of post-filtering weighting constants are another example of at least one second coding parameter value consistent with step S23 of FIG. 4.

The frequency response of the post filter 71 may be expressed as the following equation:

$$P(z) = \frac{1+\sum_{i=1}^{P} a_i \gamma_1^i z^{-i}}{1+\sum_{i=1}^{P} a_i \gamma_2^i z^{-i}}$$

where $\gamma_1$ and $\gamma_2$ represents a set of post-filtering weighting constants and $\{a_i\}$ is the linear predictive coding coefficient.

Referring to step S20 or step S23 of FIG. 4, a frequency response of a post filter 71 coupled to an output of a decoder may be adjusted based on a degree of slope or flatness of the speech signal. The post filter 71 controls the value of $\gamma_1$ and $\gamma_2$ based on the spectral response of the input speech. For instance, the adjustment of a frequency response of a post filter may involve selecting different values of post-filtering weighting constants of $\gamma_1$ and $\gamma_2$ in response to the determined slope or flatness of the speech signal. In one embodiment, $\gamma^1$ and $\gamma^2$ approximately equal 0.65 and 0.4, respectively, for generally sloped input speech consistent with the MIRS spectral response. Similarly, in one embodiment $\gamma^1$ and $\gamma^2$ approximately equals 0.63 and 0.4, respectively, for an input speech signal with a generally flat signal response.

Figure 6:
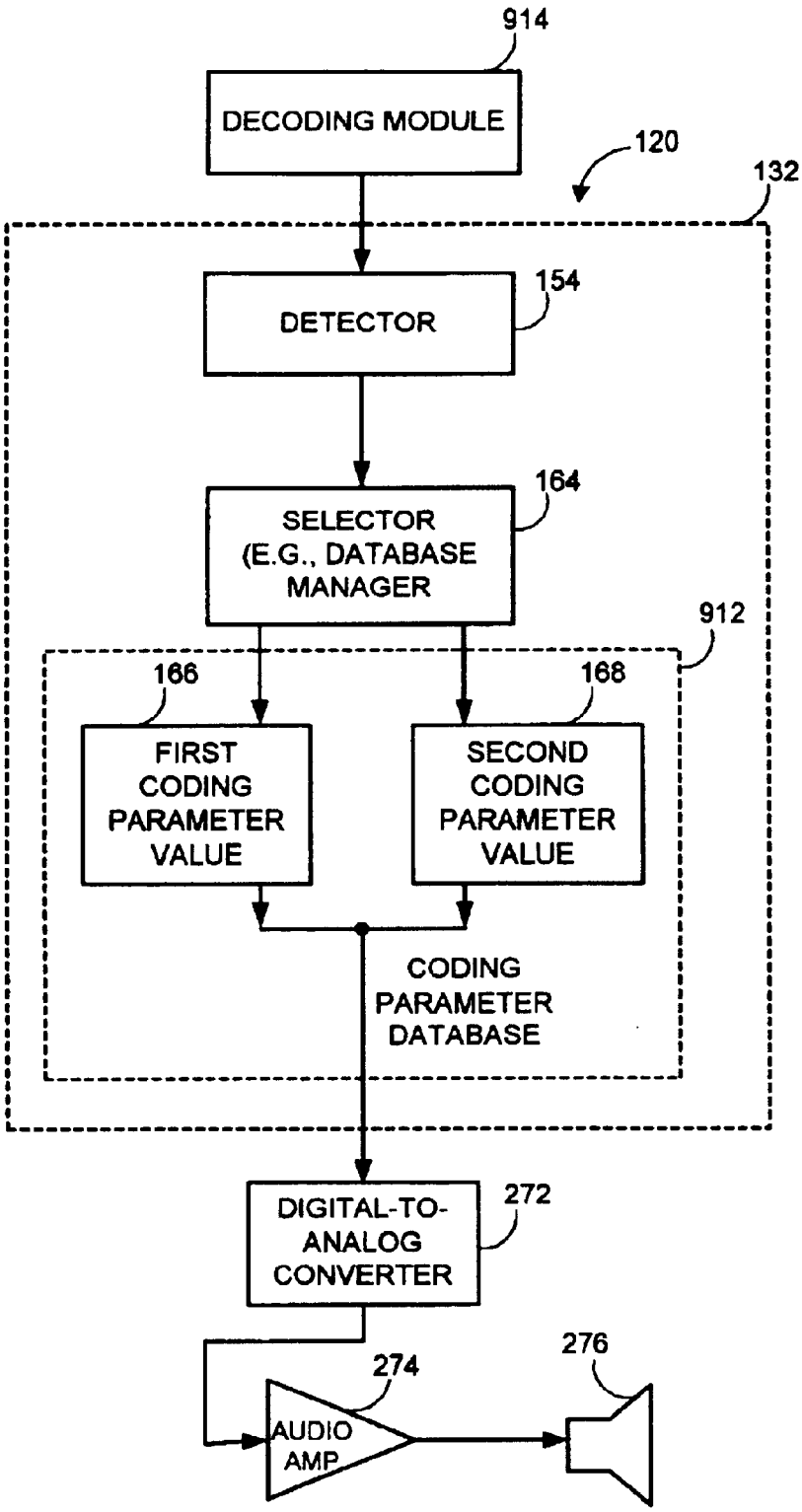
FIG. 6 is a block diagram of a decoder that supports decoding an encoded speech signal.

FIG. 6 illustrates an embodiment of decoder 120 that includes a decoding module 914 coupled to the processing module 132. In a coding system that includes an encoder and a decoder that exchange data representative of a speech signal, the processing module 132 of FIG. 6 may be used as an alternative to the processing module 132 of FIG. 1 or in addition to the processing module 132 of FIG. 1 to achieve tandem manipulation of the speech signal to a more uniform and/or perceptually enhanced speech signal.

In FIG. 6, the decoder 120 decodes the encoded signal by performing the inverse filtering operation of the encoding module 11. For example, the decoding module 914 applies an excitation signal and a filter coefficient on a frame-by-frame basis or according to some other suitable time interval as determined by the encoding module 11. The spectral detector 154 determines whether the decoded speech signal has a first frequency response, a second frequency response, or another defined frequency response. In one embodiment, the first frequency response and the second frequency response may be the equivalent of the first spectral response and the second spectral response, respectively. However, in an alternate embodiment, the first frequency response may differ from the first spectral response and the second frequency response may differ from the second spectral response.

The selector 164 (e.g., database manager) facilitates coding the speech signal with at least one first coding parameter value 166 if the speech signal conforms to the first frequency response. Otherwise, the selector 164 (e.g., database manager) facilitates coding the speech signal with at least one second coding parameter value 168 if the speech signal conforms to the second frequency response. At least one first coding parameter value 166 or at least one second coding parameter value 168 provides a perceptually enhanced speech signal and/or a more uniform reproduction of the speech signal regardless of the spectral content of the source. The first coding parameter value or values 166 and the second coding parameter value or values 168 are stored in the coding parameter database 912.

The enhanced speech signal is inputted to a digital-to-analog converter 272. An audio amplifier 274 is coupled to the digital-to-analog converter 272. In turn, the audio amplifier 274 is coupled to a speaker 276 for reproducing the speech signal with a desired spectral response.

Figure 7:
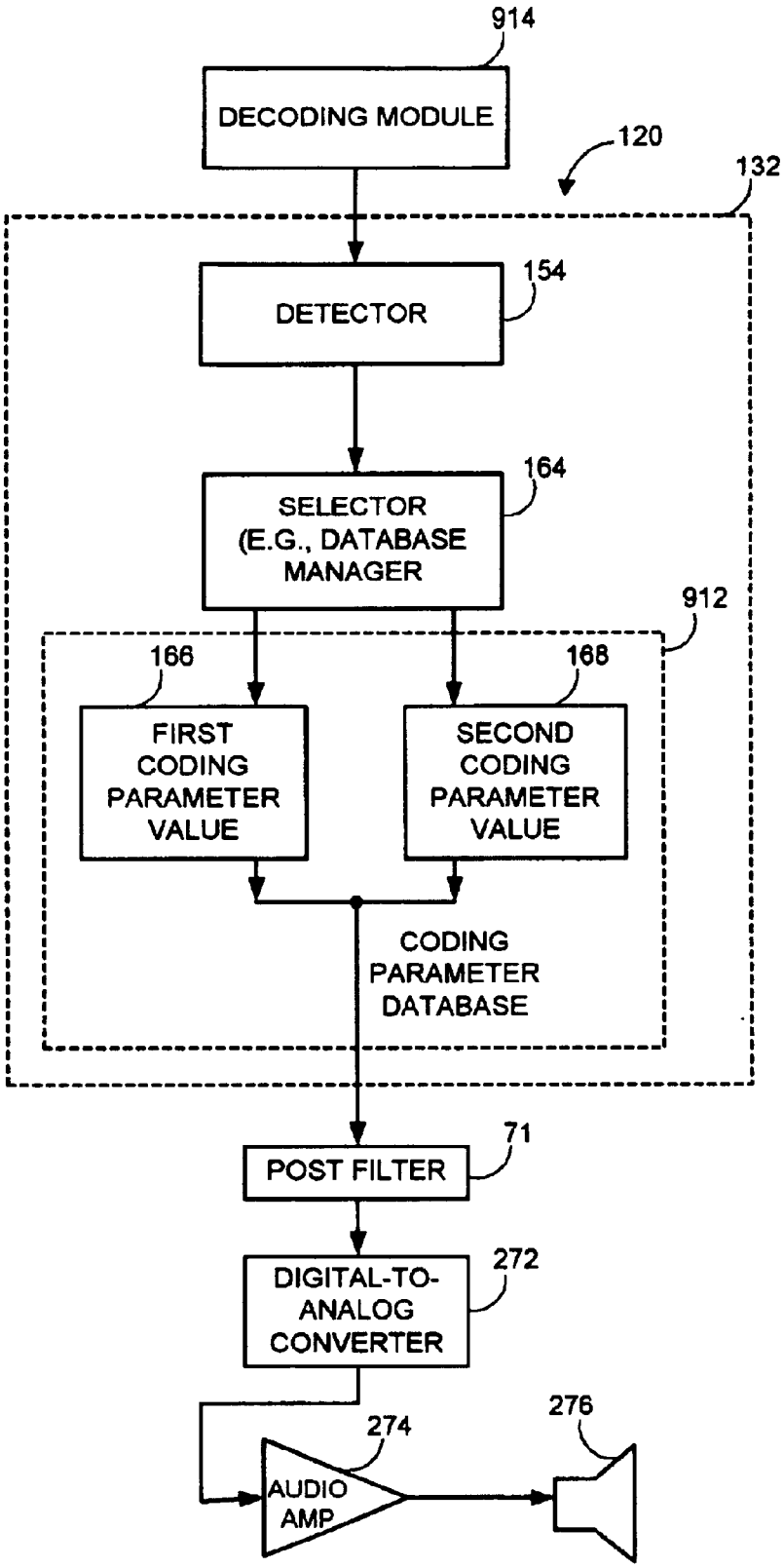
FIG. 7 is a block diagram of an alternate embodiment of a decoder in accordance with the invention.

FIG. 7 is a block diagram of an alternate embodiment of a decoder 120 including a processing module 132 in accordance with the invention. The configuration of FIG. 7 is similar to the configuration of FIG. 6 except that FIG. 7 includes the post filter 71. Like reference numbers indicate like elements in FIG. 1, FIG. 6 and FIG. 7.

Although the post-filter 71 is placed in the signal path between the coding parameter database 912 and the digital-to-analog converter 272, the post-filter 71 may be placed in the signal path at other places between decoder 120 and the digital-to-analog converter 272. For example, in an alternate configuration, the post-filter 71 may be placed in a signal path between the detector 154 and the selector 164 (e.g., database manager).

Figure 8:
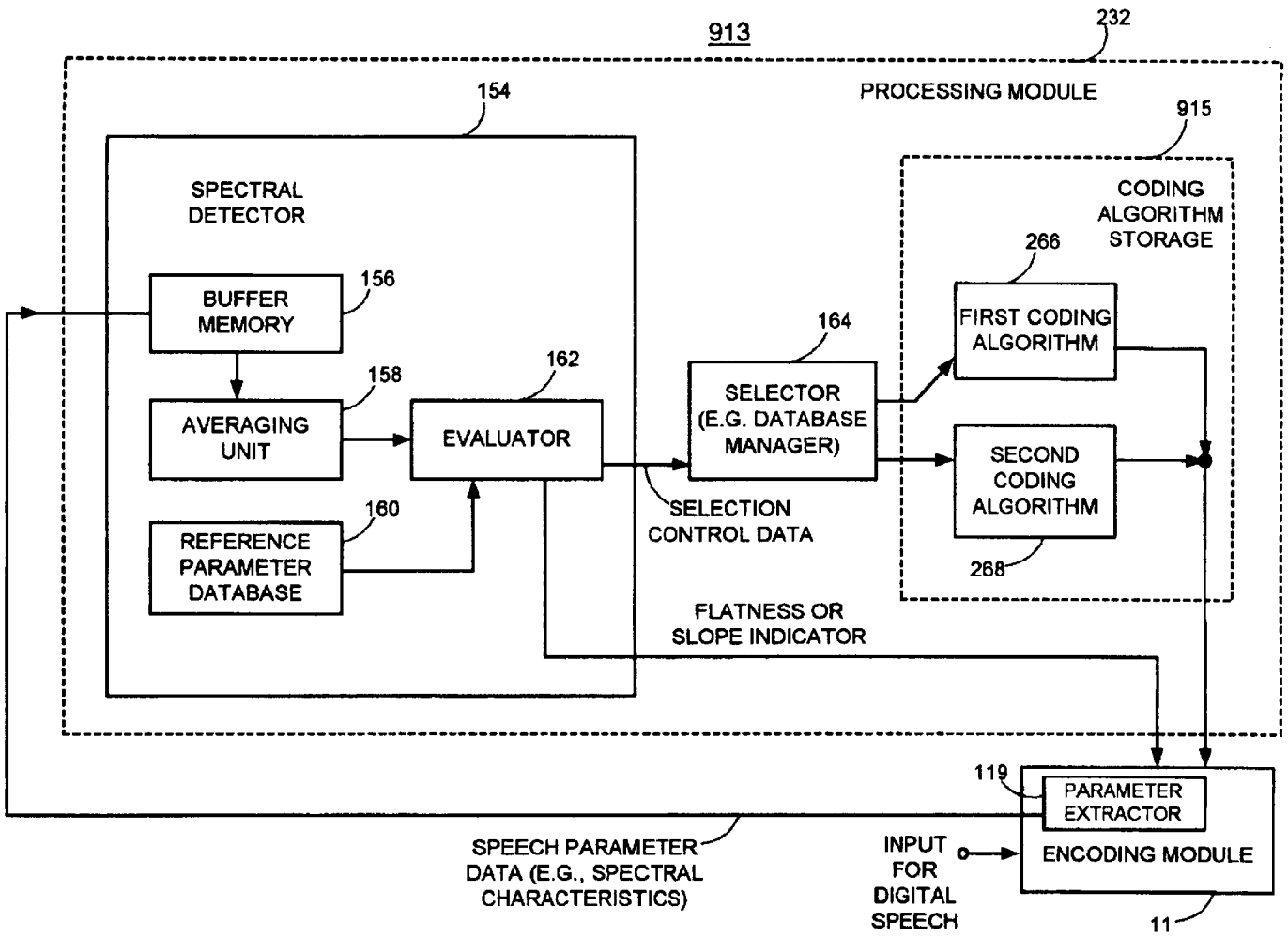
FIG. 8 is a block diagram that shows another embodiment of a processing module of an encoder.

FIG. 8 shows an encoder 913 which may be used as an alternate to encoder 911 in any embodiment disclosed herein. The encoder 913 of FIG. 8 is similar to the encoder 911 of FIG. 3 except that the coding parameter database 912 of FIG. 3 is replaced by a coding algorithm storage 915.

A processing module 232 of the encoder 913 comprises a selector 164 in communication with a coding algorithm storage 915. In practice, an assortment of different coding algorithms may be stored in the coding algorithm storage 915, which is managed by the selector 164. The different coding algorithms may be associated with corresponding different filter responses of one or more filters in an encoder or a decoder. As shown in FIG. 8, the coding algorithm storage 915 is arranged to support storage and retrieval of at least a first coding algorithm 266 and a second coding algorithm 268. The selector 164 may select or reference the first coding algorithm 266 or the second coding algorithm 268 based upon the estimated spectral content of a speech signal. For example, if the estimated spectral content of the speech signal corresponds to the first spectral response, the selector 164 may select the first coding algorithm 266. In contrast if the estimated spectral content of the speech signal corresponds to the second spectral response, the selector 164 may select the second coding algorithm 268.

Figure 9:
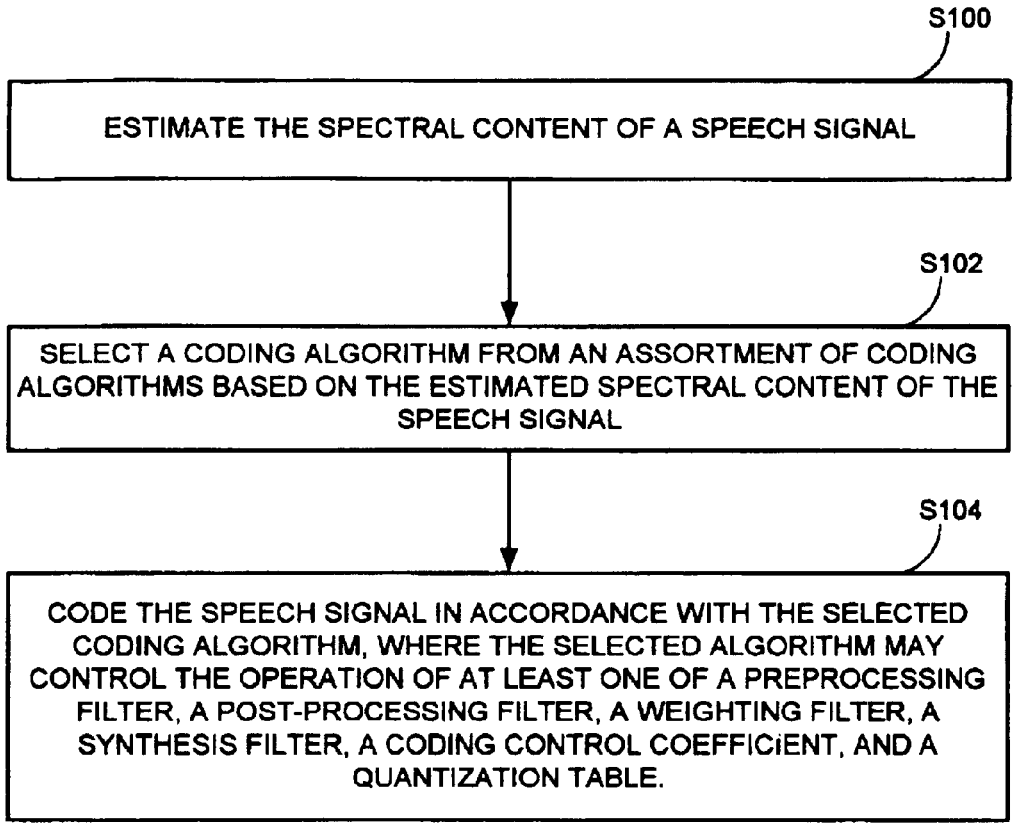
FIG. 9 is flow diagram of a method for coding a speech signal in accordance with the invention.

In FIG. 9, a method for coding a speech signal supports encoding, decoding, or both of a speech signal. The method of FIG. 9 starts in step S100.

In step S100, the spectral content of a speech signal is estimated. For example, in the encoder 11 the detector 24 may determine if the spectral content of the speech signal is representative of a defined reference spectral response. The defined reference spectral response may refer to one or more of the following: the first spectral response, the second spectral response, an IRS spectral response, an MIRS response, a sloped spectral response, and some other specified frequency response (e.g., a frequency versus amplitude plot) associated with a telecommunications network. In one embodiment, the detector 24 assumes that that the spectral response is generally stationary (i.e., remains relatively constant) for the duration of a conversation.

In an alternate embodiment, the detector 24 may periodically detect the spectral content and revise the estimation of the spectral content during a conversation that exceeds a minimum threshold duration such that a selection of a coding algorithm may be varied during a conversation.

In step S102, a coder (e.g., a processing module 232 of an encoder 11 or a decoder 120) selects a preferential coding algorithm from an assortment of coding algorithms based on the estimated spectral content of the speech signal. For example, the selector 64 selects the first coding algorithm 266 or the second coding algorithm 268 as the preferential coding algorithm from coding algorithm storage 915. The selector 164 may select preferential the coding algorithm for the duration of a conversation or for an interval (e.g., a frame or the minimum threshold duration), consistent with the estimation of step S100.

In step S102, the selection of the preferential coding algorithm may comprise selection of a desired filter response for at least one filter of an encoder or a decoder. The selection of the desired filter response may be carried out in accordance with various alternate techniques. Under a first technique, the selection of a coding algorithm comprises selection of a desired filter response of a pre-processing filter. The desired filter response is configured to enhance perceptual voice quality of the coded speech signal based on the estimated spectral content. The pre-processing filter may comprise the perceptual weighting filter 20 in the input section 10 of the encoder 11, for example.

Under a second technique, the selection of a coding algorithm comprises selection of a desired filter response of a post-processing filter. The desired filter response is configured to enhance perceptual voice quality of the coded speech signal based on the estimated spectral content. The post-processing filter may comprise a post filter 71 of a decoder 120.

Under a third technique, the selection of a coding algorithm comprises selection of a desired filter response of a weighting filter. The desired filter response is configured to enhance perceptual voice quality of the coded speech signal based on the estimated spectral content. The weighting filter may comprise a weighting filter in one or more of the following sections of the encoder 11: a weighting filter 20 in the input section 10, a weighting filter in the adaptive codebook section 14, and a weighting filter in the fixed codebook section 16.

Under a fourth technique, the selection of a coding algorithm comprises selection of a desired filter response of a synthesis filter (e.g., synthesis filter). The synthesis filter 42 may be associated with an adaptive codebook section 14 and/or a fixed codebook section 16. The desired filter response configured to enhance perceptual voice quality of the coded speech signal based on the estimated spectral content.

In accordance with a fifth technique, the selection of the coding algorithm comprises selection of a desired filter response of at least one of the synthesis filter 42 and the weighting filter 20 of an adaptive codebook section 14 of an encoder 11.

In accordance with a sixth technique, the selection of the coding algorithm comprises selection of a desired filter response of at least one of the synthesis filter 42 and the weighting filter 20 of a fixed codebook section 16 of an encoder 11. The quantization table may comprise at least one of an adaptive codebook section 14 and a fixed codebook 16.

The selection of coding algorithms may represent a hard decision because the selection of coding algorithms may select a discrete filter response that is well suited for a corresponding particular estimated spectral content. In one embodiment, once the filter response is selected, the filter response is fixed. In another embodiment, once the filter response is selected, the filter response may not be varied, unless variation of coding parameters can accommodate a desired change in the filter response.

In step S104, the coder (e.g., encoder 11 or decoder 120) codes the speech signal in accordance with the selected coding algorithm, where the selected algorithm may control the operation of at least one of a preprocessing filter, a post-processing filter, a coding control coefficient, a weighting filter, a synthesis filter, and a quantization table. Accordingly, the encoder 11 or decoder 120 may detect different spectral contents of a speech signal and tune the filter response or coding algorithm to compensate for a spectrally flat speech signal, An IRS speech signal, an MIRS speech signal, or some other spectral response of the speech signal to produce a coded or reproduced speech signal with superior perceptual characteristics that is frequency-response compensated.

Figure 10:
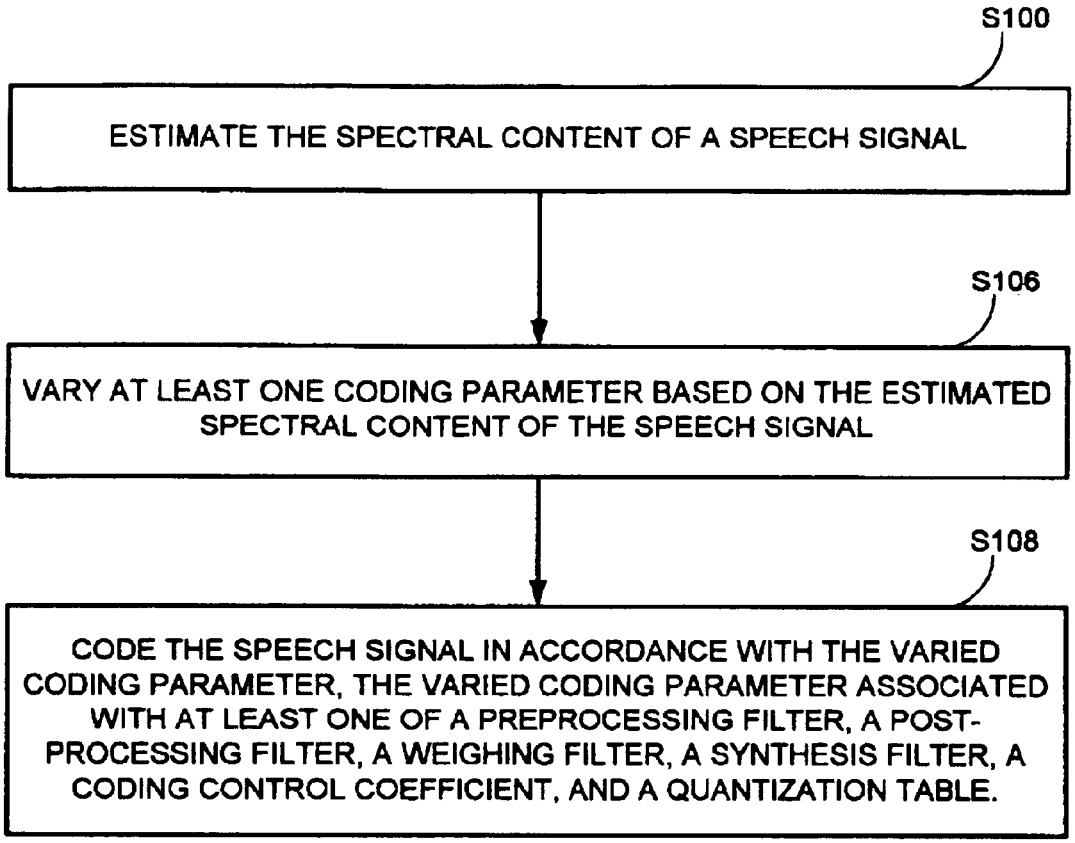
FIG. 10 is a flow diagram of another method for coding a speech signal in accordance with the invention.

In FIG. 10, a method for coding a speech signal supports encoding, decoding, or both of a speech signal. The method of FIG. 10 starts in step S100. Like reference numbers in FIG. 9 and FIG. 10 indicate like steps or procedures.

In step S106, following step S100, a coder (e.g., an encoder 11 or a decoder 120) varies or selects at least one coding parameter based on the estimated spectral content of the speech signal. For example, a desired coding parameter is varied or selected to enhance perceptual voice quality of the coded speech signal based on the estimated spectral content of a speech signal. The desired coding parameter may be varied from an initial, general-purpose coding parameter to a revised, optimal coding parameter corresponding to the estimated spectral content of the speech signal. The desired coding parameters may be varied consistent with any of the filter equations and filter parameters (or coding parameters) described elsewhere in this document. For instance, the filter parameters may be varied between a first parameter value and a second parameter value, for example. A first parameter value may be selected for input speech consistent with MIRS speech or a first spectral response, whereas a second parameter value is selected for input speech consistent with a generally flat input signal or a second spectral response.

If a speech signal satisfies a certain spectral criteria (e.g., a positively sloped spectral response), the first coding parameter value may be applied to enhance the perceptual quality and/or spectral uniformity of the speech signal. If the speech signal satisfies a different spectral criteria (e.g., a flat spectral response), the second coding parameter value may be applied to enhance the perceptual quality and/or spectral uniformity of the reproduced speech. For example, a coding system may select or vary different preferential values for one or more of the following coding parameters based on a spectral content of the input speech signal: at least one weighting filter coefficient of a perceptual weighting filter 20 of the input section 10 of the encoder 11, at least one bandwidth expansion constant for a synthesis filter 42 of the encoder 11, at least one bandwidth expansion constant for an analysis filter (e.g., LPC analyzer 30), at least one filter coefficient for a post filter 71 coupled to a decoder 70, and pitch gains per frame or sub-frame of the encoder. Preferential values for the coding parameters may be selected according to the mathematical equations that define filtering operations described elsewhere in this document.

In step S106, the variation of at least one coding parameter may be executed in accordance with various alternative techniques. Under a first technique, the variation of at least one coding parameter comprises selection of a desired coding parameter of a pre-processing filter (e.g., perceptual weighting filter 20 of the input section 10). The desired coding parameter configured to enhance perceptual voice quality of the coded speech signal based on the estimated spectral content.

Under a second technique, the variation of at least one coding parameter comprises selection of a desired coding parameter of a post-processing filter (e.g., post filter 71). The desired coding parameter configured to enhance perceptual voice quality of the coded speech signal based on the estimated spectral content.

Under a third technique, the variation of at least one coding parameter comprises selection of a desired coding parameter of a weighting filter (e.g., weighting filter 20). The desired coding parameter configured to enhance perceptual voice quality of the coded speech signal based on the estimated spectral content.

Under a fourth technique, the variation of at least one coding parameter comprises selection of a desired coding parameter of a synthesis filter (e.g., synthesis filter 42). The desired coding parameter configured to enhance perceptual voice quality of the coded speech signal based on the estimated spectral content.

Under a fifth technique, the variation of at least one coding parameter comprises selection of a desired coding parameter of at least one of a synthesis filter (e.g., synthesis filter 42) and a weighting filter (e.g., weighting filter 20) of an adaptive codebook section of an encoder.

Under a sixth technique, the variation of at least one coding parameter comprises selection of a desired coding parameter of at least one of a synthesis filter and a weighting filter of a fixed codebook section of an encoder. The quantization table comprises at least one of an adaptive codebook and a fixed codebook.

The selection or variation of the at least one coding parameter of step S106 may be referred to as a soft decision because the coding parameter values may varied in a continuous manner within certain permitted ranges to afford great flexibility in compensation for the spectral content of a speech signal. That is, the coding parameters are not necessarily restricted to discrete predetermined coding parameter values, but may be varied readily (and even instantaneously fine-tuned) as necessary to enhance the perceptual performance of the coded speech.

In step S108, the coder codes the speech signal in accordance with the varied or selected coding parameter. The varied or selected coding parameter is associated with at least one of a preprocessing filter, a post-processing filter, a coding control coefficient, the weighting filter 20, the synthesis filter 42, the post filter 71, and a quantization table. Accordingly, the encoder 11 or decoder 120 may detect different spectral contents of the speech signal and adjust at least one coding parameter to compensate for a spectrally flat speech signal, an MIRS speech signal, an IRS speech signal, or some other spectral response of the speech signal to produce a coded or reproduced speech signal with superior perceptual characteristics that is frequency-response compensated.

A multi-rate encoder may include different encoding schemes to attain different transmission rates over an air interface. Each different transmission rate may be achieved by using one or more encoding schemes. The highest coding rate may be referred to as full-rate coding. A lower coding rate may be referred to as one-half-rate coding where the one-half-rate coding has a maximum transmission rate that is approximately one-half the maximum rate of the full-rate coding. An encoding scheme may include an analysis-by-synthesis encoding scheme in which an original speech signal is compared to a synthesized speech signal to optimize the perceptual similarities or objective similarities between the original speech signal and the synthesized speech signal. A code-excited linear predictive coding scheme (CELP) is one example of an analysis-by synthesis encoding scheme. Although the signal processing system of the invention is primarily described in conjunction with an encoder 911 that is well-suited for full-rate coding and half-rate coding, the signal processing system of the invention may be applied to lesser coding rates than half-rate coding or other coding schemes.

The signal processing method and system of the invention facilitates a coding system that dynamically adapts to the spectral characteristics of the speech signal on as short as a frame-by-frame basis or another time interval. Accordingly, the coding characteristics of the encoder 911 may be selected based on the spectral content of an input speech signal to improve spectral uniformity and/or the perceptual quality of the reproduced speech. Further, the encoder 911 may apply perceptual adjustments to the speech to promote intelligibility of reproduced speech from the speech signal with the uniform spectral response.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

We claim:

1. A method for coding a speech signal comprising:

estimating a spectral content of a speech signal;

determining if the estimated spectral content of the speech signal is representative of one of a plurality of defined reference spectral responses including an IRS spectral response and an MIRS spectral response;

selecting a preferential coding algorithm from an assortment of coding algorithms based on the determining;

coding the speech signal in accordance with the selected coding algorithm, where the selected algorithm controls the operation of at least one of a pre-processing filter, a post-processing filter, a coding control coefficient, a weighting filter, a synthesis filter, and a quantization table;

wherein the coding of the speech signal in accordance with the selected coding algorithm compensates for at least one of an IRS speech signal and an MIRS speech signal to produce a frequency-response compensated speech signal.

2. The method according to claim 1 wherein the selection of the preferential coding algorithm comprises selection of a desired filter response of the pre-processing filter, the desired filter response configured to enhance perceptual voice quality of the coded speech signal based on the estimated spectral content.

3. The method according to claim 1 wherein the selection of the preferential coding algorithm comprises selection of a desired filter response of the post-processing filter, the desired filter response configured to enhance perceptual voice quality of the coded speech signal based on the estimated spectral content.

4. The method according to claim 1 wherein the selection of the preferential coding algorithm comprises selection of a desired filter response of the weighting filter, the desired filter response configured to enhance perceptual voice quality of the coded speech signal based on the estimated spectral content.

5. The method according to claim 1 wherein the selection of the preferential coding algorithm comprises selection of a desired filter response of the synthesis filter, the desired filter response configured to enhance perceptual voice quality of the coded speech signal based on the estimated spectral content.

6. The method according to claim 1 wherein the selection of the preferential coding algorithm comprises selection of a desired filter response of at least one of the synthesis filter and the weighting filter of an adaptive codebook section of an encoder.

7. The method according to claim 1 wherein the selection of the preferential coding algorithm comprises selection of a desired filter response of at least one of the synthesis filter and the weighting filter of a fixed codebook section of an encoder.

8. The method according to claim 1 wherein the quantization table comprises at least one of an adaptive codebook section and a fixed codebook section of an encoder.

9. The method according to claim 1 wherein the estimating, the determining, the selecting and the coding are performed periodically during a conversation that exceeds a duration threshold, such that during the conversation the selecting may select a different preferential coding algorithm from the assortment of coding algorithms based on the determining.

10. A method for coding a speech signal, the method comprising:

estimating a spectral content of a speech signal;

determining if the estimated spectral content of the speech signal is representative of one of a plurality of defined reference spectral responses including an IRS spectral response and an MIRS spectral response;

varying at least one coding parameter based on the determining;

coding the speech signal in accordance with the varied coding parameter, the varied coding parameter associated with at least one of a preprocessing filter, a post-processing filter, a coding control coefficient, a weighting filter, a synthesis filter, and a quantization table;

wherein the coding of the speech signal in accordance with the varied coding parameter compensates for at least one of an IRS speech signal and an MIRS speech signal to produce a frequency-response compensated speech signal.

11. The method according to claim 10 wherein the variation of the at least one coding parameter comprises selection of a desired coding parameter of the pre-processing filter, the desired coding parameter configured to enhance perceptual voice quality of the coded speech signal based on the estimated spectral content.

12. The method according to claim 10 wherein the variation of the at least one coding parameter comprises selection of a desired coding parameter of the post-processing filter, the desired coding parameter configured to enhance perceptual voice quality of the coded speech signal based on the estimated spectral content.

13. The method according to claim 10 wherein the variation of the at least one coding parameter comprises selection of a desired coding parameter of the weighting filter, the desired coding parameter configured to enhance perceptual voice quality of the coded speech signal based on the estimated spectral content.

14. The method according to claim 10 wherein the variation of the at least one coding parameter comprises selection of a desired coding parameter of the synthesis filter, the desired coding parameter configured to enhance perceptual voice quality of the coded speech signal based on the estimated spectral content.

15. The method according to claim 10 wherein the variation of the at least one coding parameter comprises selection of a desired coding parameter of at least one of the synthesis filter and the weighting filter of an adaptive codebook section of an encoder.

16. The method according to claim 10 wherein the variation of the at least one coding parameter comprises selection of a desired coding parameter of at least one of the synthesis filter and the weighting filter of a fixed codebook section of an encoder.

17. The method according to claim 10 wherein the quantization table comprises at least one of an adaptive codebook section and a fixed codebook section of an encoder.

18. The method according to claim 10 wherein the estimating, the determining, the varying arid the coding are performed periodically during a conversation that exceeds a duration threshold, such that during the conversation the varying may further vary the at least one coding parameter based on the determining.

* * * * *